US009833122B2

(12) United States Patent
Shin et al.

(10) Patent No.: US 9,833,122 B2
(45) Date of Patent: Dec. 5, 2017

(54) DISHWASHER HAVING MOVEMENT PARTS FOR THE UPPER BASKET

(71) Applicant: LG Electronics Inc., Seoul (KR)

(72) Inventors: Gapsu Shin, Seoul (KR); Moonkee Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 519 days.

(21) Appl. No.: 14/083,657

(22) Filed: Nov. 19, 2013

(65) Prior Publication Data

US 2014/0137907 A1 May 22, 2014

(30) Foreign Application Priority Data

Nov. 19, 2012 (KR) ..... 10-2012-0131081

(51) Int. Cl.
*A47L 15/50* (2006.01)

(52) U.S. Cl.
CPC ..... *A47L 15/504* (2013.01); *A47L 15/501* (2013.01)

(58) Field of Classification Search
CPC ..... A47L 15/501; A47L 15/504; A47L 15/50; A47L 15/28; A47L 15/36
USPC ..... 134/135, 147
See application file for complete search history.

(56) References Cited

U.S. PATENT DOCUMENTS

| | | | | |
|---|---|---|---|---|
| 3,822,085 | A | 7/1974 | Clark | |
| 5,480,035 | A | 1/1996 | Smith | |
| 5,860,716 | A * | 1/1999 | Good et al. | 312/311 |
| 6,974,040 | B2 | 12/2005 | Jaehrling | |
| 7,418,967 | B2 | 9/2008 | Kim | |
| 8,567,882 | B1 | 10/2013 | Garnett | |
| 2006/0237042 | A1* | 10/2006 | Weaver et al. | 134/25.2 |
| 2008/0011337 | A1 | 1/2008 | Ryu | |
| 2008/0072937 | A1* | 3/2008 | Choi et al. | 134/137 |
| 2008/0129168 | A1 | 6/2008 | Banta | |
| 2008/0156362 | A1 | 7/2008 | Shin | |
| 2008/0272072 | A1 | 11/2008 | Tynes | |
| 2009/0009040 | A1 | 1/2009 | Dellby | |
| 2010/0078048 | A1 | 4/2010 | Schessl | |
| 2010/0155280 | A1 | 6/2010 | Graute | |
| 2012/0291825 | A1* | 11/2012 | Bhajak et al. | 134/135 |

FOREIGN PATENT DOCUMENTS

| | | | |
|---|---|---|---|
| DE | 10 2006 055352 | A1 | 5/2008 |
| DE | 10 2008 062761 | B3 | 3/2010 |

OTHER PUBLICATIONS

European Search Report dated Feb. 7, 2014 for Application No. 13193374.9, 6 pages.

* cited by examiner

*Primary Examiner* — Michael Barr
*Assistant Examiner* — Rita Adhlakha
(74) *Attorney, Agent, or Firm* — Fish & Richardson P.C.

(57) ABSTRACT

A dishwasher includes a wash tub, a lower basket, a first upper basket, a second upper basket, and movement parts. The wash tub defines a space in which dishes are washed. The lower basket is disposed in the wash tub. The first upper basket is disposed over the lower basket inside the wash tub to define a first lower reception space together with the lower basket. The second upper basket is disposed over the lower basket side by side with the first upper basket to define a second lower reception space. The movement parts move the first upper basket above or below the second upper basket to increase the first lower reception space.

20 Claims, 18 Drawing Sheets

DISHWASHER HAVING MOVEMENT PARTS FOR THE UPPER BASKET

This application claims priority from Korean Patent Application No. 10-2012-0131081 filed on Nov. 19, 2012 in the Korean Intellectual Property Office, the disclosure of which is incorporated herein by reference in its entirety.

FIELD

The present disclosure relates to dishwasher technology and, for example, to a dishwasher that can adjust a dish reception space of a basket for accommodating dishes.

BACKGROUND

A dishwasher may be a home appliance that allows food leftovers on the surface of dishes to be washed by wash water sprayed at a high pressure from a spray nozzle.

The wash water may include a wash tub defining a space in which dishes are washed and a sump disposed under the wash tub to store wash water. Wash water moves to the spray nozzle by the pumping action of a wash pump mounted in the sump, and wash water moved to the spray nozzle is sprayed at a high pressure through one or more spray holes formed at the end portion of the spray nozzle. Then, wash water sprayed at a high pressure hits the surfaces of dishes, thereby causing food leftovers on dishes to drop to the bottom of the wash tub.

In some cases, a dishwasher includes a basket for receiving dishes. Various kinds of dishes may be provided to the basket, and the dishes may have various shapes according to the types of dishes. In these cases, the basket may be designed such that the basket can support various kinds of dishes with different shapes. For instance, various sizes of baskets may be disposed inside the wash tub in multiple layers.

SUMMARY

In one aspect, a dishwasher includes a wash tub defining a space in which dishes are washed, a lower basket disposed in the wash tub, and a first upper basket disposed over the lower basket inside the wash tub and configured to define a first lower reception space together with the lower basket. The dishwasher also includes a second upper basket disposed over the lower basket side by side with the first upper basket and configured to define a second lower reception space. The dishwasher further includes movement parts configured to move the first upper basket above or below the second upper basket such that the first upper basket occupies a same space over the lower back as the second upper basket, thereby increasing the first lower reception space.

Implementations may include one or more of the following features. For example, the movement parts may include a frame configured to receive the first upper basket, an adjustment part disposed on the frame and configured to adjust a height of the first upper basket, and a rail connected to the frame in a manner that enables the frame to move along the rail and to move the first upper basket above or below the second upper basket. In this example, the dishwasher may include a stopping protrusion located on the first upper basket and protruding to a side surface of the frame and the adjustment part may be configured to move in a horizontal direction, and may include a latch that limits vertical movement of the stopping protrusion. Further, in this example, the adjustment part may be rotatably disposed on a side surface of the frame and configured to lift the first upper basket from the frame.

In some implementations, the rail may include a first rail, a second rail, a third rail, and a fourth rail longitudinally arranged in left and right directions and sequentially arranged in forward and backward directions in the wash tub and side rails longitudinally disposed in forward and backward directions to connect left ends and right ends of the first to fourth rails, respectively. In these implementations, a front surface and a rear surface of the second upper basket may be mounted to the second rail and the third rail. Further, in these implementations, the dishwasher may include rollers disposed on the side rails and configured to allow the first to fourth rails to move in forward and backward directions in the wash tub.

In some examples, the dishwasher may include a guide panel that has a first side surface thereof connected to the frame and a hook that is located at a second side surface of the guide panel and that hooks to the first rail such that the frame moves along the first rail. In these examples, the guide panel may be a first guide panel disposed on a front surface of the frame, the hook may be a first hook, and the dishwasher may include a second guide panel disposed on a rear surface of the frame and a second hook located at the second guide panel and that hooks to the fourth rail such that the frame moves along the fourth rail.

In another aspect, a dishwasher includes a wash tub defining a space in which dishes are washed and a first upper basket and a second upper basket disposed side by side at an upper side of the wash tub. The dishwasher also includes a lower basket disposed under the first upper basket and the second upper basket and configured to define lower reception spaces for receiving dishes. The dishwasher further includes a movement member configured to allow the first upper basket to move to a position above or below the second upper basket, thereby increasing a maximum height of the lower reception space.

Implementations may include one or more of the following features. For example, the movement member may include a frame configured to receive the first upper basket, an adjustment part disposed on the frame and configured to adjust a height of the first upper basket, and a rail connected to the frame in a manner that enables the frame to move along the rail and to move the first upper basket above or below the second upper basket. In this example, the dishwasher may include a stopping protrusion located on the first upper basket and protruding to a side surface of the frame and the adjustment part may be configured to move in a horizontal direction and may include a latch that limits vertical movement of the stopping protrusion. Further, in this example, the adjustment part may be rotatably disposed on a side surface of the frame and configured to lift the first upper basket from the frame.

In some implementations, the rail may include a first rail, a second rail, a third rail, and a fourth rail longitudinally arranged in left and right directions and sequentially arranged in forward and backward directions in the wash tub and side rails longitudinally disposed in forward and backward directions to connect left ends and right ends of the first to fourth rails, respectively. In these implementations, a front surface and a rear surface of the second upper basket are mounted to the second rail and the third rail.

In addition, the dishwasher may include rollers disposed on the side rails and configured to allow the first to fourth rails to move in forward and backward directions in the wash tub. Further, the dishwasher may include a guide panel that has a first side surface thereof connected to the frame and a hook that is located at a second side surface of the guide panel and that hooks to the first rail such that the frame moves along the first rail.

In yet another aspect, a dishwasher includes a wash tub defining a space in which dishes are washed and a first upper basket and a second upper basket disposed side by side at an upper side of the wash tub. The dishwasher also includes a lower basket disposed under the first upper basket and the second upper basket and configured to receive dishes. The dishwasher further includes movement parts configured to move the first upper basket to a position that overlaps the second upper basket, thereby increasing a maximum height of a dish containable in the lower basket by a height of a dish containable in the first upper basket.

Implementations may include one or more of the following features. For example, the movement parts may include a frame configured to receive the first upper basket, an adjustment part disposed on the frame and configured to adjust a height of the first upper basket, and a rail connected to the frame in a manner that enables the frame to move along the rail and to move the first upper basket to the position that overlaps the second upper basket. In this example, the dishwasher may include a stopping protrusion located on the first upper basket and protruding to a side surface of the frame and the adjustment part may be configured to move in a horizontal direction and may include a latch that limits vertical movement of the stopping protrusion. Further, in this example, the adjustment part may be rotatably disposed on a side surface of the frame and configured to lift the first upper basket from the frame.

In yet another aspect, a dishwasher includes a wash tub defining a space in which dishes are washed, baskets configured to receive dishes, and a frame disposed inside the wash tub configured to receive the baskets. The dishwasher also includes adjustment parts disposed on the frame and configured to adjust a height of the baskets and a rail configured to allow the frame to move in a horizontal direction inside the wash tub and thus adjust horizontal locations of the baskets.

The foregoing and other objects, features, aspects and advantages of the present disclosure will be described in detail in the following detailed description with reference to the accompanying drawings.

DETAILED DESCRIPTION

Figure 1:
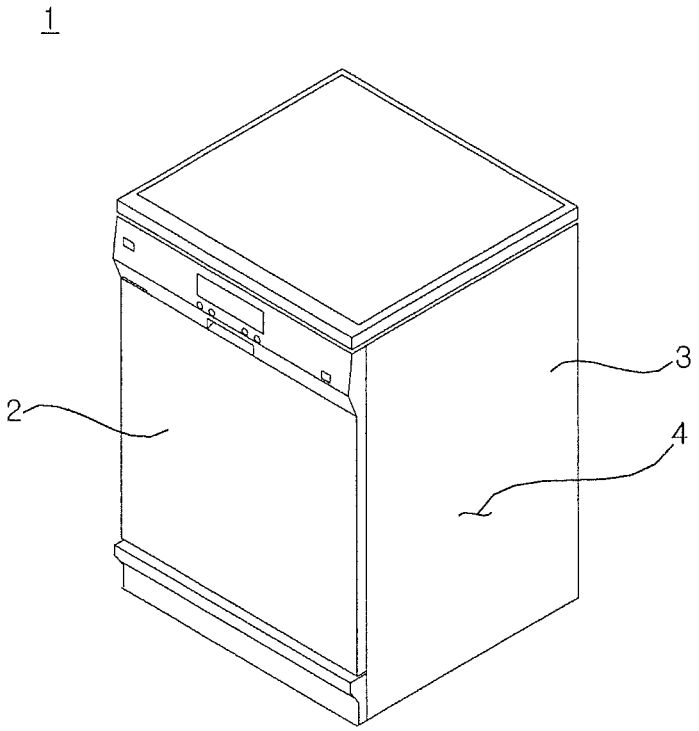
FIG. 1 is a perspective view illustrating an example dishwasher.
Figure 2:
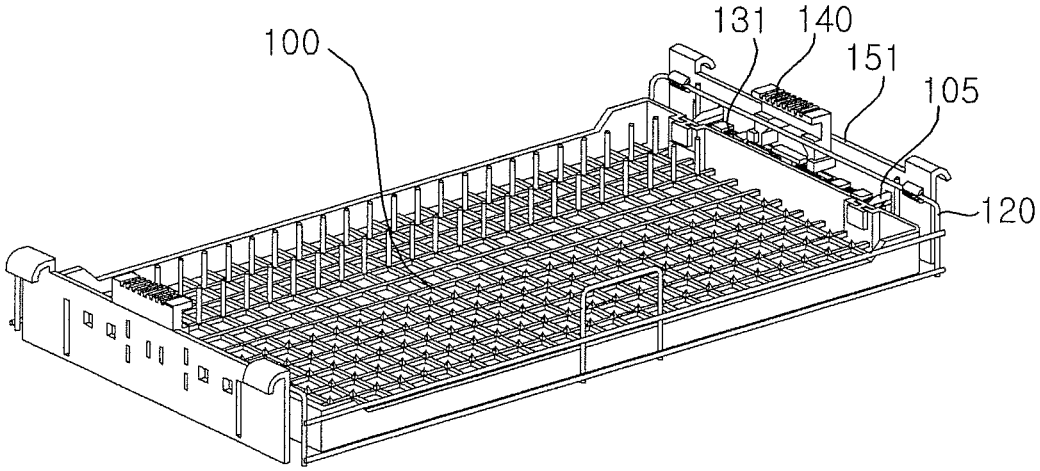
FIG. 2 is a perspective view illustrating an example basket and example peripheral parts thereof.
Figure 3:
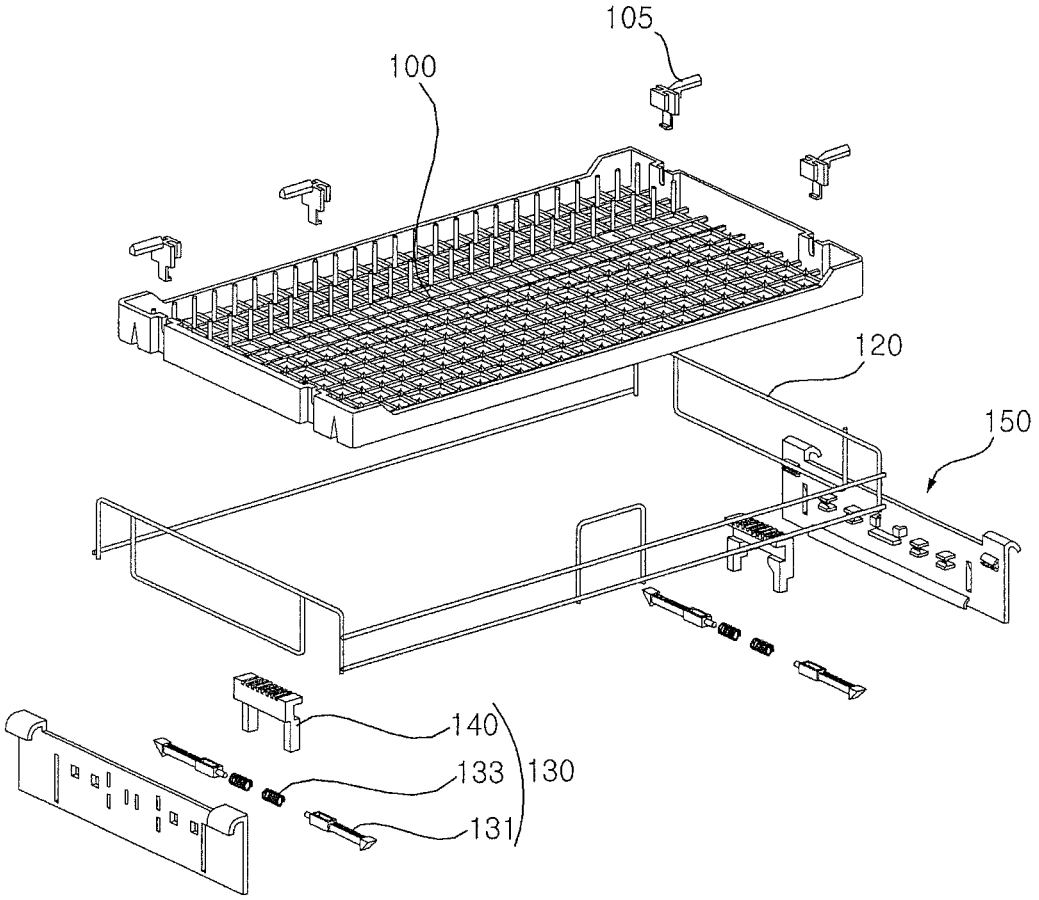
FIG. 3 is an exploded perspective view illustrating an example basket and example peripheral parts thereof.

FIG. 1 illustrates an example dishwasher. FIG. 2 illustrates an example basket and example peripheral parts thereof. FIG. 3 illustrates an example basket and example peripheral parts thereof.

Referring to FIGS. 1 to 3, a dishwasher 1 may include a wash tub 4 defining a space in which dishes are washed, a basket 100 receiving dishes, a frame 120 disposed inside the wash tub 4 to receive the basket 100, a stopping protrusion 105 formed on an outer side surface of the basket 100, and an adjustment part 130 disposed on a side surface of the frame 120 facing the stopping protrusion 105 to adjust the height of at least one side of the basket 100. The adjustment part 130 may include a latch 131 movably disposed in a horizontal direction to limit vertical movement of the stopping protrusion 105.

A cabinet 3 may provide a frame that defines the exterior of the dishwasher 1 and receives parts of the dishwasher 1. The cabinet 3 may have the front surface opened, and may allow a user to put dishes into the cabinet 3 through the front surface. The wash tub 4 may be disposed inside the cabinet 3.

A door 2 may be pivotably coupled to one surface of the cabinet 3. In some implementations, the door 2 may be pivotably coupled to the lower end of the cabinet 3. The door 2 may seal the wash tub 4.

Wash water may be sprayed into the wash tub 4. Dishes may be contained in the wash tub 4. The wash tub 4 may be opened/closed by the door 2. The wash tub 4 may be sealed by the door 2. The basket 100 receiving dishes may be disposed inside the wash tub 4.

A nozzle may be disposed inside the wash tub 4 to spray wash water to dishes. A plurality of nozzles may be used. The nozzles may be disposed at upper and lower portions of the wash tub 4 to evenly spray wash water to dishes.

Upper and lower flow pipes may be provided inside the wash tub 4 such that wash water collected in a sump is supplied to upper and lower nozzles disposed in the wash tub 4.

A water supply pipe may be provided in the wash tub 4 to be connected to an external water source, allowing water to be supplied into the wash tub 4. Also, a water discharge pipe may be provided in the wash tub 4 such that contaminated wash water is discharged out of the dishwasher 1.

A drain pump may be provided to the water discharge pipe such that wash water collected in the sump is discharged out of the dishwasher 1. A supply pipe may be provided at a lower portion of the wash tub 4 to supply wash water collected in the sump to wash tub 4, and a wash pump may be provided to the supply pipe to supply water to the upper and lower nozzles.

A fan assembly, an exhaust duct, and a nozzle may be provided inside the door 2. The fan assembly may suction air inside the wash tub 4 and then discharge air out of the wash tub 4. The exhaust duct may discharge air suctioned from the inside of the wash tub 4 by the fan assembly to the outside. The nozzle may be coupled to one side of the exhaust duct to discharge air suctioned by the fan assembly to the outside.

The basket 100 may hold dishes. The basket 100 may be disposed in plurality such that a plurality of baskets are included in the dishwasher 1. The basket 100 may be disposed to be movable forward and backward. The basket 100 may be held in the frame 120. The basket 100 may be supported by the frame 120. The frame 120 supporting the basket 100 may be disposed to be movable forward and backward in the wash tub 4. The stopping protrusion 105 may be formed on the outer side surface of the basket 100. The basket 100 may be formed of wire or synthetic resin and may have a lattice shape.

In some examples, the frame 120 may hold the basket 100. The frame 120 may be formed of various materials such as plastics, synthetic resin, and wire. The frame 120 may be disposed inside the wash tub 4. The frame 120 may be disposed to be movable forward and backward in the wash tub 4.

The adjustment part 130 may be disposed on the frame 120 to adjust the height of at least one end of the basket 100. The adjustment part 130 may be disposed on a surface of the frame 120 that faces a portion where the stopping protrusion 105 is formed.

The adjustment part 130 may adjust the height of at least one side of the basket 100. The adjustment part 130 may adjust the height of the basket 100. The adjustment part 130 may move the basket 100 in a vertical direction. The adjustment part 130 may limit the vertical movement of the basket 100.

Figure 4:
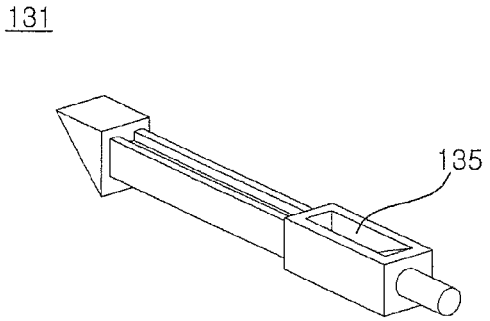
FIG. 4 is a perspective view illustrating an example latch.

FIG. 4 illustrates an example latch. FIG. 5 illustrates an example operation relationship between an example adjustment part and an example basket.

Referring to FIGS. 4 and 5, the adjustment part 130 may include a latch 131 that is disposed to be movable in a horizontal direction. The adjustment part 130 may include the latch 131 that limits the vertical movement of the stopping protrusion 105. The adjustment part 130 may adjust the height of the stopping protrusion 105. The adjustment part 130 may limit the vertical movement of the stopping protrusion 105.

The adjustment part 130 may include the latch 131 that intersects with the movement path of the stopping protrusion 105 and thus interferes with the stopping protrusion 105 when the basket 100 moves upward and downward. The latch 131 may limit the vertical movement of the stopping protrusion 105. The latch 131 may be disposed on the frame 120 so as to be movable in a horizontal direction. The latch 131 may adjust the height of the stopping protrusion 105. The latch 131 may limit the vertical movement of the basket 100. The latch 131 may adjust the height of the basket 100. The latch 131 may adjust the height of one side of the basket 100.

In some implementations, the latch 131 may be disposed to cross the movement path of the stopping protrusion 105 and, thus, when at least one side of the basket 100 moves upward and downward, the stopping protrusion 105 may be stopped by the latch 131.

For example, the latch 131 may move in a horizontal direction and the stopping protrusion 105 may move in a vertical direction, allowing the latch 131 and the stopping protrusion 105 to limit a movement path of each other. The latch 131 may be disposed on the movement path of the stopping protrusion 105.

In some examples, the latch 131 may be horizontally disposed in pairs such that the adjustment part 130 includes two latches. When an interval between the latches 131 increases, the pair of latches 131 may cross the movement path of the stopping protrusion 105.

The stopping protrusion 105 may be disposed in pairs such that the adjustment part 130 includes two stopping protrusions. The multiple stopping protrusions may be disposed side by side at left and right sides, and the latch 131 may be disposed between the stopping protrusions 105.

When the interval between the latches 131 narrows, the latch 131 may deviate from the movement path of the stopping protrusion 105. When the interval between the latches 131 narrows, the stopping protrusion 105 may freely move upward and downward. When the interval between the latches 131 increases, the latches 131 may be disposed on the movement path of the stopping protrusion 105. When the interval between the latches 131 increases, the movement of the stopping protrusion 105 may be limited by the latch 131. The movement paths of the latch 131 and the stopping protrusion 105 may cross each other. The movement paths of the latch 131 and the stopping protrusion 105 may be orthogonal to each other.

The latches 131 may be disposed in pair at left and right sides. The pair of latches 131 may be horizontally disposed. The interval between the pair of latches 131 may vary. The movement of the stopping protrusion 105 may be dependent on the interval between latches 131.

In some implementations, an elastic member 133 may be disposed between the latches 131. The elastic member 133 may be a spring. The elastic member 133 may increase the interval between the latches 131. The elastic member 133 may allow the latches 131 to be disposed on the movement path of the stopping protrusion 105. A protrusion may be formed on sides of the latches that are opposite to each other such that springs can be inserted into the protrusion.

The adjustment part 130 may further include the elastic member 133 that applies an elastic force to the latch 131 in a direction of the movement path of the stopping protrusion 105.

In some examples, the latch 131 may have an inclination surface on a contact surface with the stopping protrusion 105 at a lower side surface of the latch 131 and, thus, may be pushed when the stopping protrusion 105 moves upward, allowing the interval between the latches 131 to be narrowed.

In some implementations, the latch 131 may have an inclination surface on a contact surface with the stopping protrusion 105, and thus may move away from the stopping protrusion 105 when the stopping protrusion 105 moves upward. The latch 131 may contact the stopping protrusion 105. The stopping protrusion 105 may contact the lower end of the latch 131 when the stopping protrusion 105 moves upward. The inclination surface may be formed on a surface where the latch 131 is located on the movement path of the stopping protrusion 105. The inclination surface may be formed on a lower side of the latch 131.

Figure 5A:
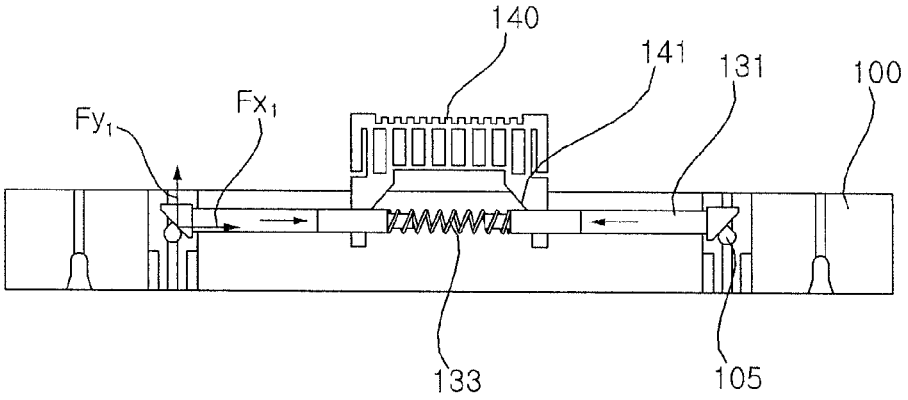
FIGS. 5A and 5B are views illustrating an example operation relationship between an example adjustment part and an example basket.

FIG. 5A illustrates a direction of a force ($Fx_1$) which the stopping protrusion 105 applies to the latch 131 when the stopping protrusion 105 moves upward by a force ($Fy_1$).

Referring to FIG. 5A, the inclination surface may change the direction of the force that the stopping protrusion 105 applies to the latch 131. The stopping protrusion 105 may apply a force to the latch 131 in a horizontal direction when the stopping protrusion 105 moves upward. When the stopping protrusion 105 moves upward, the latch 131 may move in a horizontal direction.

When the stopping protrusion 105 is disposed in plurality, the latches 131 disposed in pair may move in a horizontal direction. The interval between the latches 131 may be narrowed. The latches 131 may move out of the movement path of the stopping protrusion 105.

In some examples, an upper surface of the stopping protrusion 105 contacting the latch 131 may be formed to incline and, thus, the interval between the latches 131 may be allowed to be narrowed when the stopping protrusion 105 moves upward.

The inclination surface may be formed on the upper side of the stopping protrusion 105. The inclination surface formed at the stopping protrusion 105 and the inclination surface formed at the latch 131 may correspond to each other. When the basket 100 moves upward, the stopping protrusion 105 may push the latch 131 in a horizontal direction. The latch 131 may be moved in a horizontal direction by the stopping protrusion 105. The interval between the latches 131 may be narrowed. The latches 131 may move out of the movement path of the stopping protrusion 105.

Figure 5B:
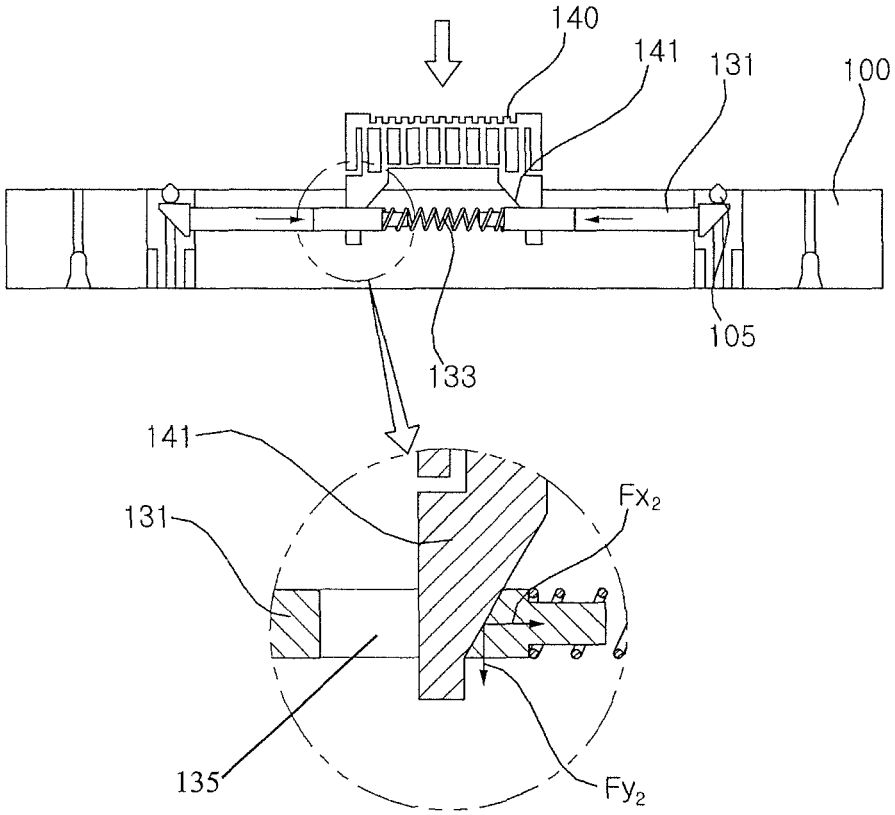

FIG. 5B illustrates the direction of a force ($Fx_2$) applied to the latch when a button is pushed by a force ($Fy_2$).

Referring to FIG. 5B, the dishwasher 1 may further include a button 140 disposed between the latches 131 and allowing the interval between the latches 131 to be narrowed when pushed. A pushing part 141 may be formed at both ends of the lower side of the button 140 to downwardly protrude. An insertion part 135 (see also FIG. 4) may be formed in the latch 131 such that the pushing part 141 can be inserted in a vertical direction.

The latch 131 may be disposed in plurality, and the elastic member 133 may be disposed between the latches 131 to adjust the interval between the latches 131. Also, the button 140 may be further provided to be restored by the elastic member 133.

The button 140 may be disposed between the latches 131. The button 140 may be disposed over a location where the latches 131 face each other. The button 140 may adjust the interval between the latches 131. When the button 140 is pushed, the interval between the latches 131 may be narrowed. When the interval between the latches 131 is narrowed, the button 140 may move downward. The upper portion of the button 140 may be formed to be substantially flat. The upper portion of the button 140 may be formed to be concave such that the button 140 can be easily pushed by the hand.

In some implementations, the adjustment part 130 may further include a button 140 for adjusting the horizontal movement of the latch 131 by moving upward and downward. A pushing part 141 may be formed at the button 140 to downwardly protrude. An insertion part 135 may be formed in the latch 131 such that the pushing part 141 is inserted in a vertical direction. At least one of the pushing part 141 and the insertion part 135 may have inclination surfaces on surfaces facing each other. The latch 131 may move away from the stopping protrusion 105 when the pushing part 141 moves downward. The pushing part 141 may be formed at both ends of the lower side of the button 140 to downwardly protrude. The pushing part 141 may be disposed at both left and right ends of the button 140. The pushing part 141 may be longitudinally formed in a vertical direction. The insertion part 135 may be formed in the latch 131 such that the pushing part 141 can be inserted into the insertion part 135 in a vertical direction. The pushing part 141 may be a groove formed in a vertical direction. The pushing part 141 may be formed such that the insertion part 135 can move upward and downward. When the pushing part 141 moves upward, the insertion part 135 may move in a horizontal direction. When the insertion part 135 moves in a horizontal direction, the pushing part 141 may move in a vertical direction.

In some examples, an inclination surface may be formed on surfaces where the pushing parts 141 face each other, and an inclination surface may be formed on the insertion part 135 to correspond to the inclination surface formed on the pushing part 141. In this case, when the pushing part 141 moves, the latch 131 may be pushed in a direction orthogonal to the movement direction of the pushing part 141, allowing the interval between the latches 131 to be narrowed.

The pushing part 141 may be longitudinally and downwardly formed at both left and right sides of the button 140. The pushing part 141 may have inclination surfaces where the pushing parts 141 face each other. The inclination surface on the pushing part 141 may be formed to direct force toward the central line of the button 140. The inclination surface may change the direction of force applied to the button 140.

The lower end of the pushing part 141 may protrude so as to be always inserted into the insertion part 135. The inclination surface of the pushing part 141 may be formed to be increasingly closer to the center of the button 140 from the lower side to the upper side thereof. The pushing part 141 may have an increasingly larger thickness from the lower side to the upper side thereof.

An inclination surface may be formed on the insertion part 135. The inclination surface formed at the insertion part 135 may correspond to the inclination surface formed at the pushing part 141. A force applied to the button 140 may move the latch 131 in a horizontal direction due to the inclination surfaces formed on the insertion part 135 and the pushing part 141. When the button 140 is pushed, the interval between the latches 131 may be narrowed.

Figure 6:
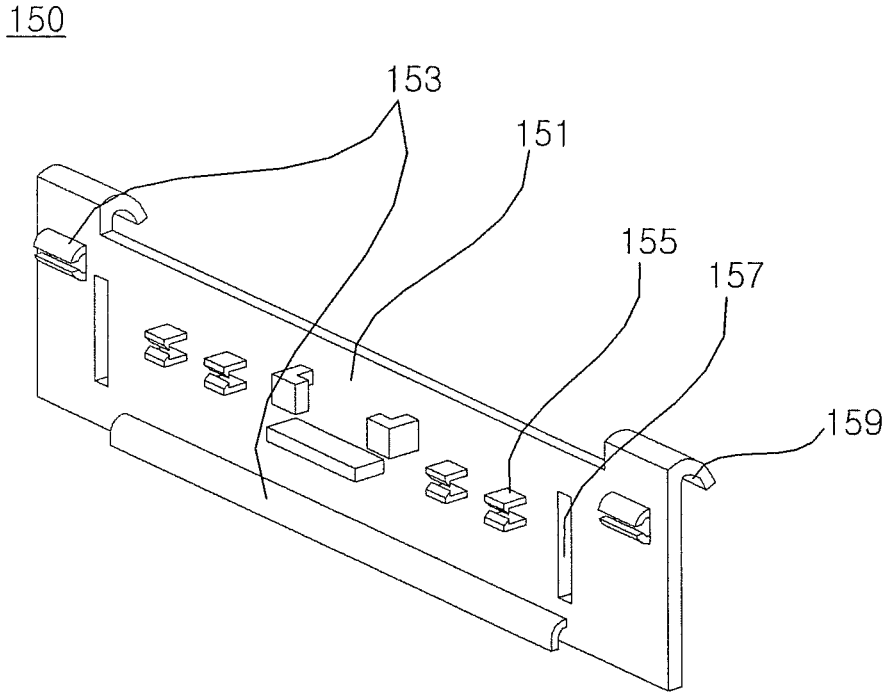
FIG. 6 is a perspective view illustrating an example guide panel.

FIG. 6 illustrates an example guide panel 150.

Referring to FIG. 6, the dishwasher 1 may further include a guide panel 150 that includes: a support panel 151; a mounting part 153 disposed in plurality on one side surface such that the support panel 151 is mounted to the frame 120; and a guide clamp 155 for guiding the latch 131 and the button 140 such that the latches 131 move in a horizontal direction and the button 140 moves in a vertical direction.

The dishwasher 1 may include the guide panel 150. The guide panel 150 may be mounted to the frame 120. The guide panel 150 may include the support panel 151. The support panel 151 may be mounted to the frame 120. The mounting part 153 may be formed on one side surface of the support panel 151. The mounting part 153 may couple the support panel 151 to the frame 120. The mounting part 153 may detachably couple the support panel 151 to the frame 120. The mounting part 153 may be disposed in plurality.

The guide panel 150 may include the guide clamp 155. The guide clamp 155 may be disposed on the support panel 151 and may include multiple guide clamps. The guide clamps 155 may fix the latch 131 such that the latch 131 moves in a horizontal direction. The guide clamps 155 may fix the button 140 such that the button 140 moves in a vertical direction. The guide clamps 155 may maintain a minimum height of the button 140. The guide clamps 155 may surround the center of the latch 131. The guide clamps 155 may interrupt the vertical movement of the latch 131. The guide clamps 155 may surround the side surface of the button 140, and may interrupt the horizontal movement of the button 140. The adjustment part 130 may have a vertical movement groove 157 for guiding the vertical movement of the stopping protrusion 105. The guide panel 150 may have the vertical movement groove 157 formed in a vertical direction such that the stopping protrusion 105 can be inserted into the guide panel 150 to be movable in a vertical direction. The vertical movement groove 157 may be formed in the guide panel 150. The guide panel 150 may include multiple vertical movement grooves 157 that are located at left and right sides of a surface of the guide panel 157 and extend in a vertical direction. The vertical movement groove 157 may be formed on the movement path of the stopping protrusion 105. The vertical movement groove 157 may guide the movement direction of the stopping protrusion 105. The vertical movement groove 157 may be formed such that the stopping protrusion 105 can move in a vertical direction within the groove. The stopping protrusion 105 may be inserted into the vertical movement groove 157. The stopping protrusion 105 may include a guide protrusion that corresponds to the vertical movement groove 157. The guide protrusion may be inserted into the vertical movement groove 157.

In some implementations, the stopping protrusion 105 may be disposed in pairs on the front surface and the rear surface of the basket 100, respectively. The stopping protrusion 105 may be disposed in pairs, and the button 140 may be disposed between the stopping protrusions 105 so as to be movable in a vertical direction. The adjustment part 130 may be disposed on the front surface and the rear surface of the frame 120, respectively. The guide panel 150 may be disposed on the front surface and the rear surface of the frame 120, respectively. A hook 159 may be formed on the guide panel 150. In some examples, the stopping protrusion 105 may be disposed at both surfaces of the basket 100, and the adjustment part 130 may be disposed at a portion facing the stopping protrusion 105 to obliquely fix the basket 100.

Figure 7:
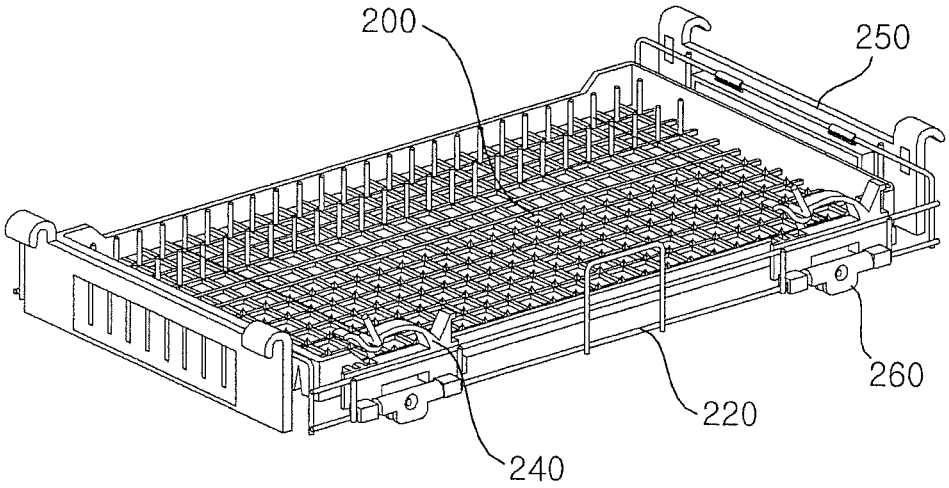
FIG. 7 is a perspective view illustrating an example basket including an example rotatable adjustment part.
Figure 8:
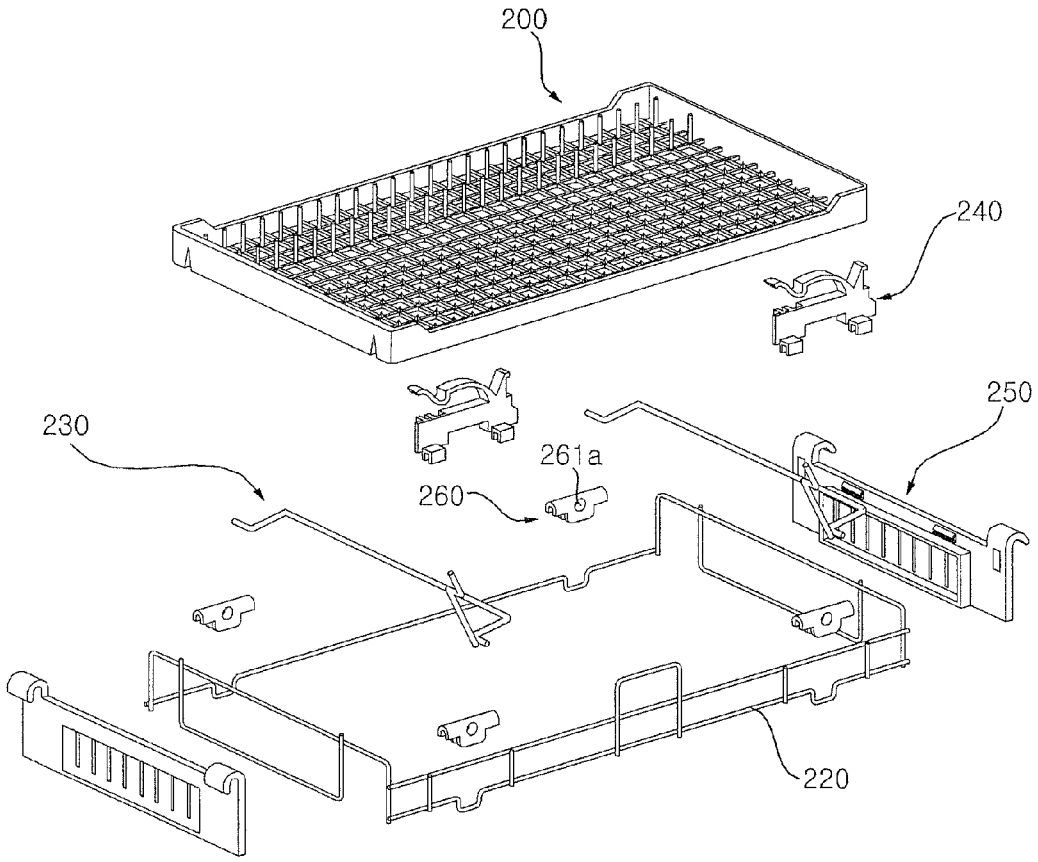
FIG. 8 is an exploded perspective view illustrating an example basket and example peripheral parts thereof.
Figure 9A:
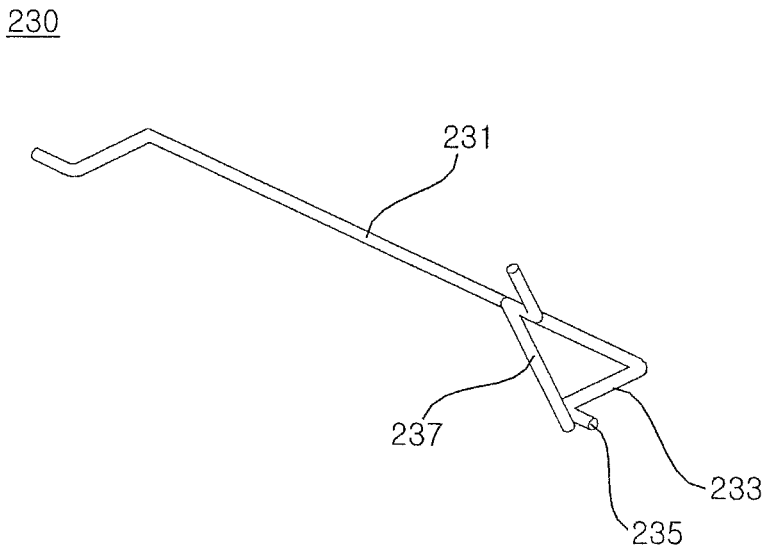
FIGS. 9A and 9B are perspective views illustrating example rotatable adjustment parts.
Figure 9B:
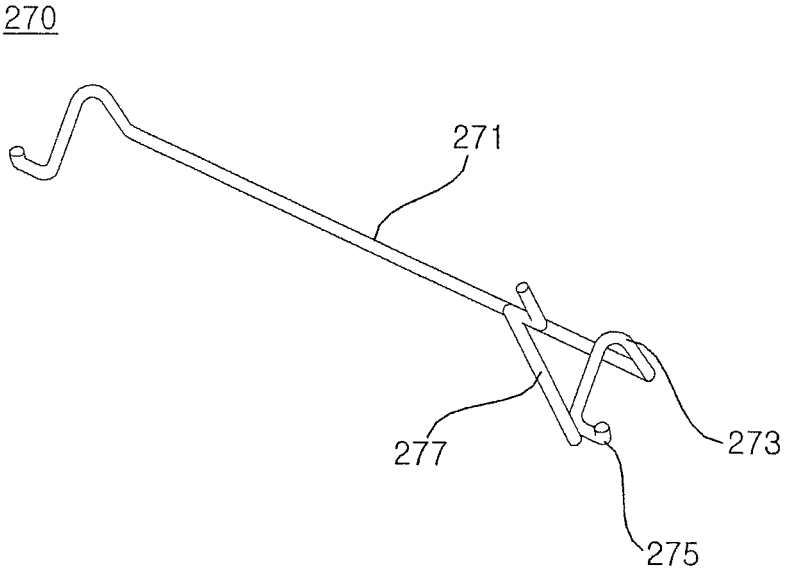
Figure 10:
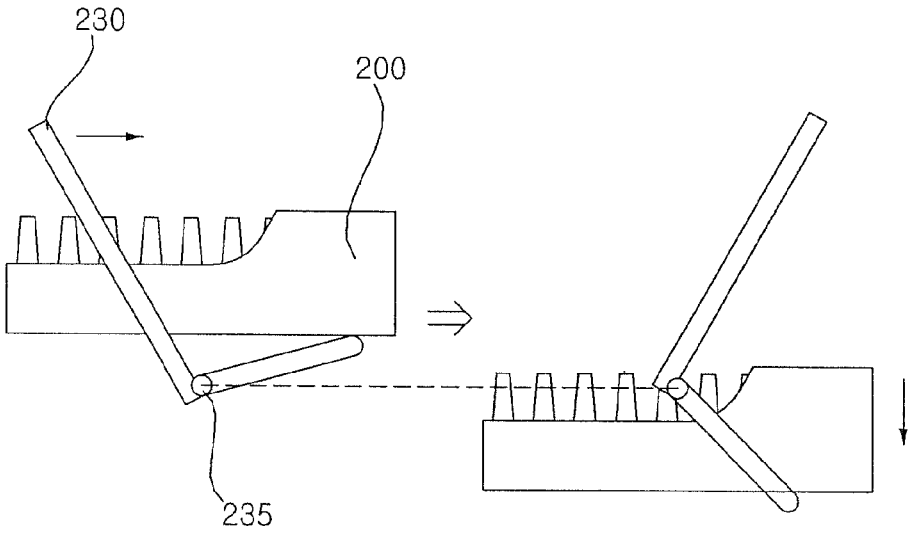
FIG. 10 is a view illustrating an example operation relationship between an example adjustment part and an example basket.

The adjustment part 130 may be disposed on the frame 120 to adjust a dish reception space of the basket 100 by allowing the upward movement of the basket 100 and limiting the downward movement of the basket 100. FIG. 7 illustrates an example basket 200 including rotatable adjustment parts 230 and 270. FIG. 8 illustrates the basket 200 and example peripheral parts thereof. FIG. 9 illustrates the rotatable adjustment parts 230 and 270. FIG. 10 illustrates an example operation relationship between the adjustment parts 230 and 270 and the basket 200.

Referring to FIGS. 1 and 7 to 10, a dishwasher 1 may include a wash tub 4 defining a space in which dishes are washed, a basket 200 receiving dishes, a frame 220 disposed inside the wash tub 4 to receive the basket 200, and adjustment parts 230 and 270 rotatably disposed on the side surface of the frame 220 to lift at least one end of the basket 200 from the frame 220.

The adjustment parts 230 and 270 may rotate in linkage with the vertical movement of the basket 200. In addition, the adjustment parts 230 and 270 may be curved to support the basket 200, and may adjust the height of at least one side of the basket 200 according to the degree of rotation.

Wash water may be sprayed into the wash tub 4. Dishes may be contained in the wash tub 4. The wash tub 4 may be opened/closed by the door 2. The wash tub 4 may be sealed by the door 2. The basket 200 receiving dishes may be disposed inside the wash tub 4.

The basket 200 may hold dishes. The basket 200 may be disposed in plurality such that multiple baskets are included in the dishwasher 1. The basket 200 may be disposed to be movable forward and backward. The basket 200 may be held in the frame 220. The basket 200 may be supported by the frame 220. The frame 220 supporting the basket 200 may be disposed to be movable forward and backward in the wash tub 4. The basket 200 may be formed of wire or synthetic resin and may have a lattice shape.

The frame 220 may hold the basket 200. The frame 220 may be formed of various materials, such as synthetic resin and wire. The frame 220 may be disposed inside the wash tub 4. The frame 220 may be disposed to be movable forward and backward in the wash tub 4.

The adjustment parts 230 and 270 may adjust the height of at least one side of the basket 200. The adjustment parts 230 and 270 may adjust the height of the basket 200. The adjustment parts 230 and 270 may move the basket 200 in a vertical direction. The adjustment parts 230 and 270 may limit the vertical movement of the basket 200.

The adjustment parts 230 and 270 may be rotatably disposed on the side surface of the frame 220. The adjustment parts 230 and 270 may lift at least one end of the basket 200 from the frame 220. The adjustment parts 230 and 270 may adjust the height of at least one end of the basket 200.

In some implementations, the adjustment parts 230 and 270 may be disposed in plurality to adjust the heights of the front and rear sides of the basket 200. The adjustment parts 230 and 270 may be disposed so as to lift the bottom of the front side and the bottom of the rear side of the basket 200.

Support parts 231 and 271 and connection parts 233 and 273 may be formed to have a substantially U-shape such that the support parts 231 and 271 support the undersurface of the basket 200 and the connection parts 233 and 273 extend toward the top of the side surface of the basket 200. In some examples, the adjustment parts 230 and 270 may include support parts 231 and 271 disposed to support the undersurface of the basket 200, rotation protrusions 235 and 275 spaced from the support parts 231 and 271 such that the support parts 231 and 271 have a certain rotation radius and are rotatably mounted in the frame 220, and connection parts 233 and 273 connecting between the rotation protrusions 235 and 275 and the support parts 231 and 271.

The support parts 231 and 271 may support the bottom of the basket 200. The support parts 231 and 271 may be formed of wire. The support parts 231 and 271 may extend from the bottom of one side surface to the bottom of the other side surface of the basket 200. The support parts 231 and 271 may be disposed to be orthogonal to the movement direction of the basket 200.

The rotation protrusions 235 and 275 may be rotatably disposed on the frame 220. The rotation protrusions 235 and 275 may be disposed to have a certain radius of rotation with respect to the support parts 231 and 271. The rotation protrusions 235 and 275 may be disposed spaced from the support parts 231 and 271 by a certain distance. The rotation axes of the rotation protrusions 235 and 275 may be disposed parallel to support parts 231 and 271. The rotation axes of the rotation protrusions 235 and 275 may be disposed spaced from support parts 231 and 271 by a certain distance.

The rotation protrusions 235 and 275 may be connected to the connection parts 233 and 273. The support parts 231 and 271 may be connected to the connection parts 233 and 273. In some implementations, the rotation protrusions 235 and 275 and the connection parts 233 and 273 may be disposed at left and right sides of the frame 220 to support both side surfaces of the support parts 231 and 271. The rotation protrusions 235 and 275 may be disposed at the left and right side surfaces of the frame 220, respectively. The connection parts 233 and 273 may be connected to the rotation protrusions 235 and 275. The connection parts 233 and 273 may be connected to the support parts 231 and 271. The connection parts 233 and 273 may be disposed parallel to the side walls of the frame 220. The connection parts 233 and 273 may be disposed parallel to the side walls of the basket 200. The connection parts 233 and 273 may be disposed to be orthogonal to the rotation axes of the rotation protrusions 235 and 275. The connection parts 233 and 273 may be orthogonally connected to the support parts 231 and 271. The rotation protrusions 235 and 275 may be formed at the ends of the connection parts 233 and 273. The connection parts 233 and 273 may have a straight-line shape. The connection parts 233 and 273 may be bent at a certain angle. The bending angle of the connection parts 233 and 273 may vary with the height of the basket 200 and the locations of levers 237 and 277, described in more detail below.

The dishwasher 1 may further include an adjustment part support 260 that is mounted to the frame 220 and has a rotation hole 261*a* which the rotation protrusions 235 and 275 are inserted into.

The adjustment part support 260 may have the rotation hole 261*a*. The rotation protrusions 235 and 275 may be inserted into the rotation hole 261*a* formed in the adjustment part support 260. The adjustment part support 260 may be mounted to the frame 220. The adjustment part support 260 may be detachably mounted in the frame 220. The adjustment part support 260 may have a groove corresponding to the frame 220 to be mounted to the frame 220. The adjustment part support 260 may also be formed of synthetic resin by injection-molding. The adjustment part support 260 may be mounted on both side surfaces of the frame 220.

For example, the center of the adjustment part support 260 may downwardly protrude, and the frame may be formed in a structure corresponding thereto, interrupting the forward and backward movement of the adjustment part support 260. The lower side of the adjustment part support 260 may be opened to receive the frame 220. A rotation hole 261*a* may be formed at the center of the adjustment part support 260.

Figure 11:
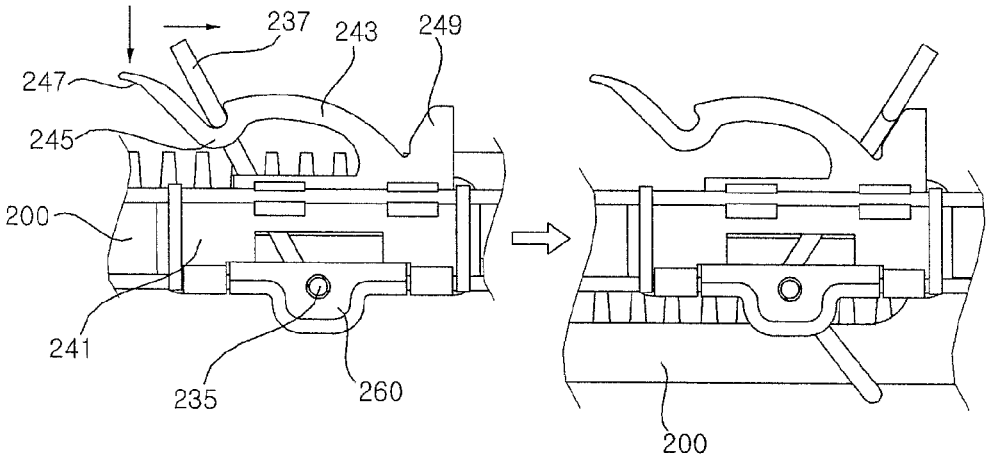
FIG. 11 is a view illustrating an example operation relationship between an example adjustment part and an example holder.

FIG. 11 illustrates an example operation relationship between the adjustment parts 230 and 270 and a holder 240.

Referring to FIG. 11, the dishwasher 1 may further include levers 237 and 277 that extend from the ends of the connection parts 233 and 273 and adjust the rotation degree of the support parts 231 and 271.

The levers 237 and 277 may be disposed perpendicular to the rotation axis. The levers 237 and 277 may extend from the ends of the connection parts 233 and 273. The levers 237 and 277 may have a bent shape at a certain angle with respect to the connection parts 233 and 273. The ends of the levers 237 and 277 may be always disposed at a higher location than the frame 220. The levers 237 and 277 may be connected to the rotation protrusions 235 and 275. The levers 237 and 277 may be connected to the connection parts 233 and 273. The levers 237 and 277 may adjust the rotation degree of the support parts 231 and 271. The levers 237 and 277 may be disposed on the right side surface of the basket 200.

In some examples, the levers 237 and 277 may be bent at a certain angle with respect to the connection parts 233 and 273, allowing the levers 237 and 277 to pivot via the vertical direction of the rotation protrusions 235 and 275 when the basket 200 moves upward and downward.

The levers 237 and 277 may be bent at a certain angle with respect to the connection parts 233 and 273. The levers 237 and 277 may pivot in forward and backward directions of the connection protrusions. When the levers 237 and 277 pivot, the basket 200 may move upward and downward.

In some implementations, the dishwasher 1 may further include a holder 240 that is disposed at the side wall of the frame 220 such that the levers 237 and 277 can be stopped and fixed by the holder 240. In these implementations, the holder 240 may include a holder support part 241 mounted in the frame 220, a stopping part 243 extending from the holder support part 241 to guide the rotation of the levers 237 and 277, and a curved part 245 formed at the end portion of the stopping part 243 to allow the levers 237 and 277 to be stopped and fixed thereby.

The holder 240 may be disposed on the side wall of the frame 220. The holder 240 may limit the movement range of the levers 237 and 277. The holder 240 may fix the levers 237 and 277. The holder 240 may be disposed at one side of the frame 220 on which the levers 237 and 277 are disposed. The holder 240 may be disposed in plurality at one side of the frame 220 in forward and backward directions. The holder 240 may be formed of synthetic resin by injection-molding.

In some examples, the holder 240 may include a holder support part 241 mounted to the frame 220, a stopping part 243 having one side connected to the holder support part 241 and the other side extending in the rotation direction of the levers 237 and 277 as they upwardly move the basket 200, and a curved part 245 formed at the end of the other side of the stopping part 243 and downwardly and convexly curved to allow the levers 237 and 277 to be stopped and fixed thereby.

The holder support part 241 may be mounted to the frame 220. The holder support part 241 may have a panel shape disposed on the side wall of the frame 220. The holder support part 241 may be detachably mounted in the frame 220. The holder support part 241 may be disposed at the top of the adjustment part support 260. The holder support part 241 may be disposed on the movement path of the levers 237 and 277.

One side of the stopping part 243 may be connected to the holder support part 241. The other side of the stopping part 243 may extend in the rotation direction of the levers 237 and 277 as they upwardly move the basket 200. The other side of the stopping part 243 may extend to the front side of the basket 200. The other side of the stopping part 243 may extend toward the door 2.

The curved part 245 may be formed on the end of the other side of the stopping part 243. The curved part 245 may have a downwardly and convexly curved shape to allow the lever to be stopped and fixed thereby. The curved part 245 may have a curved shape in a direction of the rotation axis of the levers 237 and 277.

In some implementations, the levers 237 and 277 may be formed to be bent so as to be inserted into the curved part 245 through the side surface of the curved part 245. The levers 237 and 277 may be formed to be bent in a direction of the curved part 245 at a surface where the levers 237 and 277 contact the curved part 245.

The levers 237 and 277 may be bent in a direction of the other side surface at the side surface of the curved part 245. The levers 237 and 277 curved to the other side surface may be curved in a direction opposite to the rotation axis.

In other implementations, the levers 237 and 277 may include mounting protrusions that protrude from the side surface thereof and are inserted into the curved part 245. The mounting protrusions may protrude from the side surfaces of the levers 237 and 277. The mounting protrusion may be inserted into the curved part 245.

In some examples, the upper end of the curved part 245 that is opened may have a protruding step to interrupt the restoration of the levers 237 and 277. The levers 237 and 277 may be bent to be inserted into the curved part 245, and the curved part 245 may include the protrusion step by which the levers 237 and 277 are stopped. The protrusion step may protrude toward the rotation direction of the levers 237 and 277 that lift the basket 100.

In other examples, the curved part 245 may be formed to have a hook shape, allowing the levers 237 and 277 to be hooked. The levers 237 and 277 may be mounted in the curved part 245 having a hook shape. The levers 237 and 277 may be inserted into and mounted in an opened surface of the curved part 245.

In some implementations, the dishwasher 1 may further include a release part 247 that extends from the curved part 245 such that the levers 237 and 277 are released from the curved part 245 by downwardly moving the curved part 245.

In some examples, the holder 240 may further include a release part 247 that extends from the curved part 245 such that the levers 237 and 277 are released from the curved part 245 by downwardly moving the curved part 245. The release part 247 may be connected to the curved part 245. The release part 247 may extend from the curved part 245 and may extend in the opposite direction of the mounting part. The release part 247 may be disposed parallel to the basket 200. The release part 247 may extend toward the rotation direction of the levers 237 and 277. The release part 247 may be formed of an elastic material.

The stopping part 243 may be upwardly bent. The stopping part 243 may be formed of an elastic material. The stopping part 243 may guide the movement of the levers 237 and 277. The stopping part 243 may be formed to be bent at the same curvature as the movement path of the levers 237 and 277.

In some implementations, the holder 240 may further include a limit part 249 that is disposed in the rotation direction of the levers 237 and 277 as they downwardly move the basket 200 and is connected to the holder support part 241 to limit the rotation of the levers 237 and 277. In some examples, the dishwasher 1 may further include a limit part 249 that is formed at the holder support part 241 and is disposed in the rotation direction of the levers 237 and 277 to limit the rotation of the levers 237 and 277 when the basket 200 moves downward.

The limit part 249 may be disposed at the opposite side to the curved part 245. The limit part 249 may be disposed at a location where the levers 237 and 277 can interrupt the downward movement of the basket 200. The limit part 249 may be formed to allow the levers 237 and 277 to be stopped and fixed. For example, the limit part 249 may be a protrusion located on the movement path of the levers 237 and 277.

The holder support part 241, the stopping part 243, the curved part 245, the release part 247, and the limit part 249 may be integrally formed. The holder 240 may be integrally formed. The holder 240 may be formed of synthetic resin by injection-molding.

In some implementations, the dishwasher 1 may further include a guide panel 250. The guide panel 250 may be mounted at the front and rear sides of the frame 220. A mounting part may be disposed on one surface of the guide panel 250 such that the guide panel 250 can be mounted to the frame 220. The mounting part may fix the guide panel 250 to the frame 220. A hook may be formed on the guide panel 250.

Figure 12:
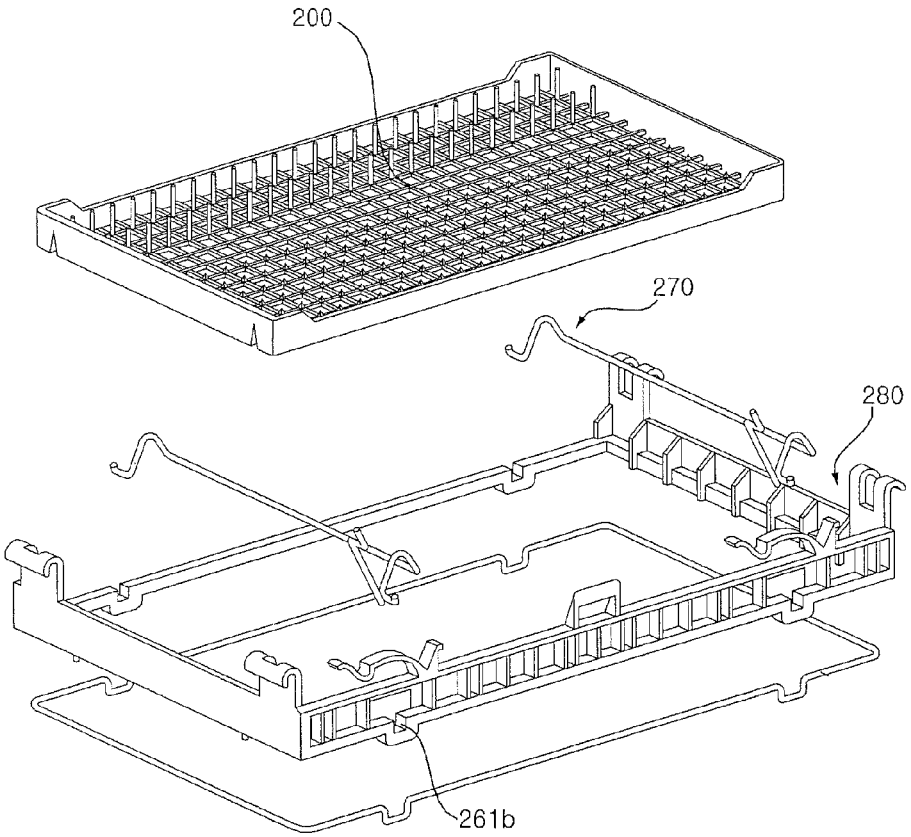
FIG. 12 is an exploded perspective view illustrating an example movement part and example peripheral parts thereof.

FIG. 12 illustrates example movement parts 321 and 323 and example peripheral parts thereof.

Referring to FIG. 12, the holder 240 and the frame 220 may be integrally formed, and the frame 220 may have a rotation hole 261*b* which the rotation protrusions 235 and 275 are inserted into.

In some examples, the basket 200 may be supported by an integral frame 280 and, in the integral frame 280, the adjustment parts 230 and 270 may be rotatably disposed to adjust the height of the basket 200. The integral frame 280 may include all of the holder 240, the frame 220, the adjustment part support 260, and the guide panel 250. The integral frame 280 may be integrally formed of synthetic resin by injection-molding.

Figure 13:
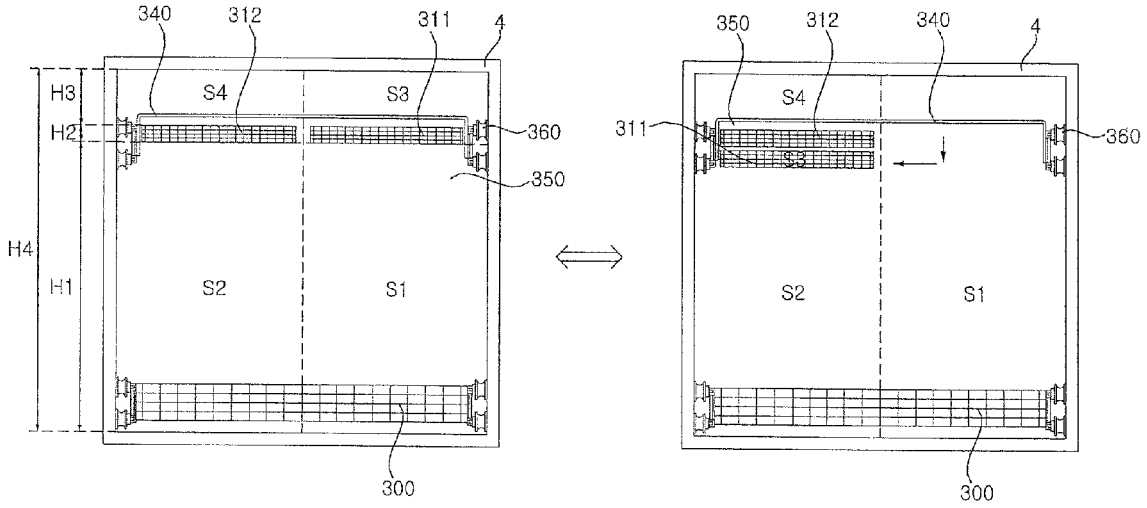
FIG. 13 is a view illustrating an example space adjusting method of an example dishwasher.

FIG. 13 illustrates an example space adjusting method of a dishwasher 1.

Referring to FIG. 13, the dishwasher 1 may include a wash tub 4 defining a space in which dishes are washed, a lower basket 300 disposed in the wash tub 4, a first upper basket 311 disposed over the lower basket 300 inside the wash tub 4 to define a first lower reception space S1 together with the lower basket 300, a second upper basket 312 disposed over the lower basket 300 side by side with the first upper basket 311 to define a second lower reception space S2, and movement parts 321 and 323 (see FIGS. 14 and 15) that move the first upper basket 311 to the second upper basket 312 to increase the first lower reception space S1.

Wash water may be sprayed into the wash tub 4. Dishes may be contained in the wash tub 4. The wash tub 4 may be opened/closed by the door 2. The wash tub 4 may be sealed by the door 2. The baskets 300, 311, and 312 receiving dishes may be disposed inside the wash tub 4.

The baskets 300, 311, and 312 may hold dishes. The baskets 300, 311, and 312 may be disposed in plurality. The baskets 300, 311, and 312 may be disposed to be movable forward and backward. The baskets 300, 311, and 312 may be formed of wire or synthetic resin and may have a lattice shape.

The frame 320 (see FIGS. 14 and 15) may hold the basket. The frame 320 may be formed of various materials, such as synthetic resin and wire. The frame 320 may be disposed inside the wash tub 4. The frame 320 may be disposed to be movable forward or backward in the wash tub 4.

The baskets 300, 311, and 312 may be separately disposed at upper and lower portions of the wash tub 4. The lower basket 300 may be disposed at the lower portion of the wash tub 4. The upper baskets 311 and 312 may be disposed over the lower basket 300. The dish reception capacity of the lower basket 300 may be different from those of the upper baskets 311 and 312. The dish reception capacity may vary with the areas of the bottoms of the baskets 300, 311, and 312. The dish reception capacity may vary with a distance from the bottoms of the baskets 300, 311, and 312 to obstacles located on the baskets 300, 311, and 312. Here, obstacles may include other baskets 300, 311, and 312. Here, obstacles may be a distance from the top of the wash tub 4. The dish reception capacity may increase or decrease according to the dish reception space.

The dish reception space may refer to a gap from the bottoms of the baskets 300, 311, and 312 to obstacles located on the baskets 300, 311, and 312. The dish reception space may vary with the locations and sizes of the baskets 300, 311, and 312 that are disposed.

The first upper basket 311 may be disposed inside the wash tub 4. The first upper basket 311 may be disposed at an upper side of the wash tub 4. The first upper basket 311 may limit the dish reception space of the lower basket 300. The first upper basket 311 may limit the dish reception capacity of the lower basket 300. The first lower reception space S1 may be formed between the first upper basket 311 and the lower basket 300. The first lower reception space S1 may determine the size, shape, and height of a dish that can be contained in the lower basket 300. The first lower reception space S1 may vary with the location of the first upper basket 311.

The second upper basket 312 may be disposed inside the wash tub 4. The second upper basket 312 may be disposed side by side with the first upper basket 311. The second upper basket 312 may limit the dish reception space of the lower basket 300. The second upper basket 312 may limit the dish reception capacity of the lower basket 300. The second lower reception space S2 may be formed between the second upper basket 312 and the lower basket 300. The second lower reception space S2 may determine the size, shape, and height of a dish that can be contained in the lower basket 300. The second lower reception space S2 may vary with the location of the second upper basket 312.

The lower basket 300 may be divided into a first lower basket 300 and a second lower basket 300 that are disposed side by side at left and right sides. However, for convenience of explanation, the lower basket 300 will be explained as being integrally formed.

The entire bottom of the lower basket 300 may be divided into a first lower bottom located under the first upper basket 311 and a second lower bottom located under the second upper basket 312. The first lower bottom and the second lower bottom may form the entire bottom of the lower basket 300. The first lower bottom may become the bottom of the first lower reception space S1. The second lower bottom may become the bottom of the second lower reception space S2.

When the first upper basket 311 and the second upper basket 312 are disposed side by side, a space S3 may be formed over the first lower reception space S1. The space S3 may be a space between the bottom of the first upper basket 311 and the ceiling of the wash tub 4. A space S4 may be a space between the bottom of the second upper basket 312 and the ceiling of the wash tub 4.

The heights of the first lower reception space S1 and the second lower reception space S2 may be determined by a distance from an obstacle located on the top of the lower basket 300. For convenience of explanation, although the first upper basket 311 and the second upper basket 312 move, the first lower bottom and the second lower bottom will be defined as being stationary.

The first and second lower reception spaces S1 and S2 may be determined by a relation with an obstacle located on the top of the first and second lower bottoms that are defined as above. The first and second lower reception capacities may be determined by a relation with an obstacle located on the top of the first and second lower bottoms that are defined as above.

For example, when the first upper basket 311 is removed from the wash tub 4, the first lower reception space S1 may be a space from the first lower bottom defined as above to the ceiling of the wash tub 4. As another example, when the first upper basket 311 is placed on the second upper basket 312, the first lower reception space S1 may be a space from the first lower bottom defined as above to the ceiling of the wash tub 4.

In the above two examples, the first lower reception space S1 may be recognized as being the same.

In some implementations, the first lower reception space S1 may be formed between the first upper basket 311 and the lower basket 300. The first low reception space S1 may be a space between the first lower bottom and the first upper basket 311 located over the first lower bottom.

The second upper basket 312 may be disposed side by side with the first upper basket 311. The second lower reception space S2 may be formed between the second upper basket 312 and the lower basket 300. The second lower reception space S2 may be a space between the second lower bottom and the second upper basket 312.

The movement parts 321 and 323 (see FIGS. 14 and 15) may be configured to move the first upper basket 311 to the second upper basket 312. The movement parts 321 and 323 may increase or decrease the first lower reception space S1. The movement parts 321 and 323 may increase the height from the first lower bottom on which dishes can be placed.

Figure 14:
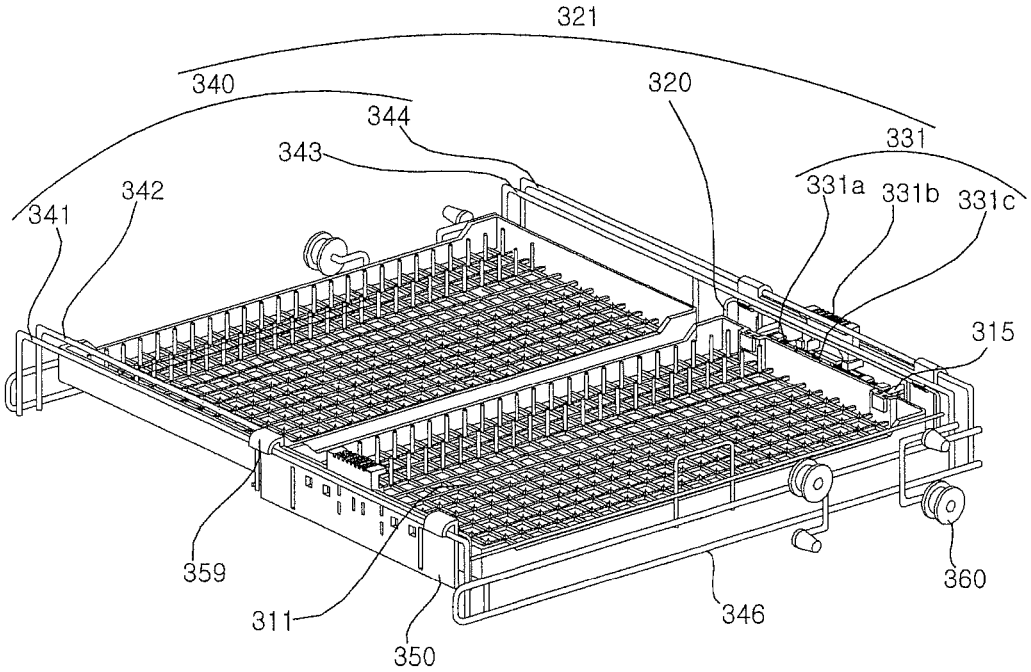
FIG. 14 is a perspective view illustrating an example basket including an example movement part and example peripheral parts thereof.
Figure 15:
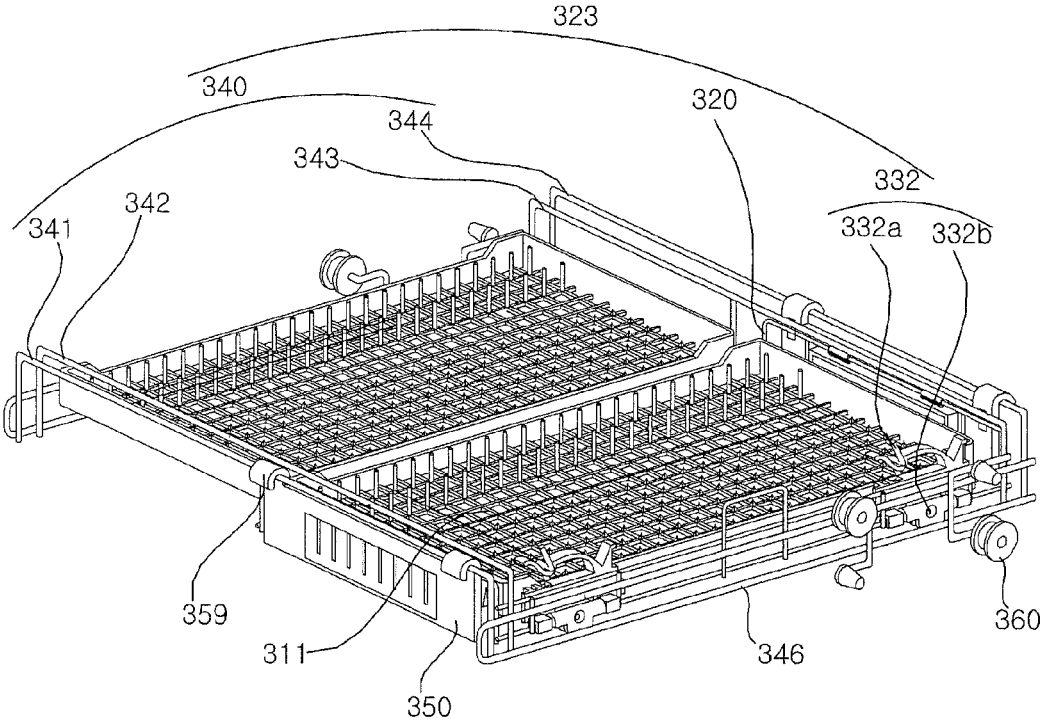
FIG. 15 is a perspective view illustrating an example basket including an example movement part and example peripheral parts thereof.

FIG. 14 illustrates an example basket including an example movement part and example peripheral parts thereof. FIG. 15 illustrates another example basket including an example movement part and example peripheral parts thereof.

Referring to FIGS. 14 and 15, movement parts 321 and 323 may include a frame 320 receiving a first upper basket 311, adjustment parts 331 and 332 disposed on the frame 320 to adjust the height of the first upper basket 311, and a rail 340 connected to the frame 320 such that the frame 320 can move to the second upper basket 312.

The movement parts 321 and 323 may include the frame 320. The frame 320 may hold the baskets 311 and 312. The frame 320 may support the baskets 311 and 312. The frame 320 may be connected to the rail 340. The adjustment parts 331 and 332 may be disposed at the frame 320. The frame 320 may be movably connected to the rail in a horizontal direction. The frame 320 may move in a horizontal direction in the wash tub 4.

The first upper basket 311 may be disposed in the frame 320. The first upper basket 311 may be housed in the frame 320. The first upper basket 311 may be supported by the adjustment parts 331 and 332. The height of the first upper basket 311 may be adjusted. The height of the first upper basket 311 may be adjusted by the adjustment parts 331 and 332.

The adjustment parts 331 and 332 may adjust the height of the first upper basket 311. The adjustment parts 331 and 332 may adjust the height of one side of the first upper basket 311. The adjustment parts 331 and 332 may be disposed in plurality.

The rail 340 may be connected to the frame 320. The rail 340 may support the frame 320. The rail 340 may be configured such that the frame 320 can move in left and right directions. The rail 340 may be formed of wire. The rail 340 may be connected to the second upper basket 312. The rail 340 may support the second upper basket 312.

In some implementations, the dishwasher 1 may further include a stopping protrusion 315 formed on the first upper basket 311 and protruding to the side surface of the frame 320. The adjustment part 331 may be movably disposed in a horizontal direction, and may include latch 331*a* that limits the vertical movement of the stopping protrusion 315.

The stopping protrusion 315 may be formed on the first upper basket 311. The stopping protrusion 315 may be formed on the outer side surface of the first upper basket 311. The stopping protrusion 315 may protrude to the side surface of the frame 320. The vertical movement of the stopping protrusion 315 may be limited by the latch 331*a*. The movement path of the stopping protrusion 315 may cross the movement path of the latch 331*a*. The movement path of the stopping protrusion 315 may orthogonally cross the movement path of the latch 331*a*. The stopping protrusion 315 may be disposed in pairs on the front surface and the rear surface of the first upper basket 311 side by side.

The latch 331*a* may limit the vertical movement of the stopping protrusion 315. The latch 331*a* may move in a horizontal direction. The latch 331*a* may cross the movement path of the stopping protrusion 315. The movement path of the latch 331*a* may orthogonally cross the movement path of the stopping protrusion 315. The latch 331*a* may be disposed in pairs at the front and rear sides of the frame 320, respectively.

The latches 331*a* may be disposed in pairs at left and right sides. An elastic member 331*c* may be disposed between the latches 331*a*. The elastic member 331*c* may be a spring. A button 331*b* may adjust the location of the latch 331*a*. The button 331*b* may be disposed between the latches 331*a*.

The button 331*b* may adjust an interval between the latches 331*a*. When the button 331*b* is pushed, the interval between the latches 331*a* may be narrowed. When the button 331*b* is pushed, the latch 331*a* may move out of the movement path of the stopping protrusion 315. The elastic member 331*c* may restore the location of the latch 331*a*.

In other examples (see FIG. 15), the adjustment part 332 may be rotatably disposed on the side surface of the frame 320 to lift the first upper basket 311 from the frame 320.

The adjustment part 332 may be disposed on the side surface of the frame 320. The adjustment part 332 may be rotatably disposed. The adjustment part 332 may be spaced from the rotation axis, and may extend to the bottom of the first upper basket 311. The adjustment part 332 may be bent so as to support the bottom of the first upper basket 311. The adjustment part 332 may be connected to left and right side surfaces of the frame 320 so as to support both ends of the first upper basket 311.

The adjustment part 332 may include a lever 332*a* that lifts the first upper basket 311. The lever 332*a* may extend from a portion that is rotatably connected to the frame 320. A holder may be disposed on the side surface of the frame 320. The holder may be disposed on the top of the rotation axis of the adjustment part 332. The holder may limit the movement range of the lever 332*a*. The holder may limit the lever 332*a* to a specific location. The holder may fix the lever 332*a* to fix the height of the first upper basket 311.

The lever 332*a* may include a rotation protrusion 332*b*. The rotation protrusion 332*b* may be disposed on the rotation axis of the adjustment part 332. The rotation protrusion 332*b* may be rotatably inserted into the frame 320. The rotation protrusion 332*b* may be connected to the lever 332*a*.

The rail 340 may include a first rail 341, a second rail 342, a third rail 343 and a fourth rail 344 that are longitudinally arranged in left and right directions and are sequentially arranged in forward and backward directions in the wash tub 4, and side rails 346 that are longitudinally disposed in forward and backward directions to connect the left ends and the right ends of the first to fourth rails 341, 342, 343 and 344, respectively. The front surface and the rear surface of the second upper basket 312 may be mounted in the second rail 342 and the third rail 343.

The rail 340 may be disposed inside the wash tub 4. The rail 340 may support the frame 320. The rail 340 may support the first upper basket 331 and the second upper basket 312. The rail 340 may be longitudinally disposed in left and right directions. The rail 340 may be formed of wire. The rail 340 may be disposed in plurality.

The rail 340 may be parallelly disposed in left and right directions. The rail 340 may be disposed in plurality in forward and backward directions. The first rail 341, the second rail 342, the third rail 343, and the fourth rail 344 may be sequentially disposed from the front side to the rear side. An interval between the second rail 342 and the third rail 343 may be sufficiently wide such that the second upper basket 312 can be disposed therebetween. The first upper basket 311 disposed side by side with the second upper basket 312 may be supported by the first rail 341 and the fourth rail 344. The second rail 342 and the third rail 343 may support the front side and the rear side of the frame 320.

The first upper basket 311 may be supported by the first rail 341 and the fourth rail 344 to be movable in left and right directions. The both ends of the first rail 341, the second rail 342, the third rail 343, and the fourth rail 344 may be bent in a downward direction of the wash tub 4.

The side rail 346 may be longitudinally disposed in forward and backward directions. The side rail 346 may be disposed in plurality in left and right directions. The side rail 346 may connect the left and right ends of the first rail 341, the second rail 342, the third rail 343, and the fourth rail 344 in a straight-line. The side rail 346 may support the left and right ends of the first rail 341, the second rail 342, the third rail 343, and the fourth rail 344 such that the left and right ends thereof are aligned in a line. The side rail 346 may be disposed to be movable in forward and backward directions in the wash tub 4. The side rail 346 may be disposed to be movable to the door 2.

The side rail 346 may be disposed in plurality in a vertical direction. The second rail 342 and the third rail 343 may support the front surface and the rear surface of the second upper basket 312. The side rail 346 may be disposed in plurality so as to support the loads of the first and second upper baskets 311 and 312 and the frame 320. The side rail 346 may be disposed such that a roller 360 can rotate.

In some implementations, the roller 360 may be disposed on the side rail 346 to allow the rail to move in forward and backward directions in the wash tub 4. The roller 360 may be disposed on the side rail 346. The roller 360 may be disposed in plurality on the side rail 346. The side rail 346 may be disposed at left and right sides, and the side rail 346 disposed at one side may be disposed in plurality in a vertical direction.

In some examples, the dishwasher 1 may further include a guide panel 350 that has one side surface thereof connected to the frame 320 and the other side surface thereof with a hook 359 that hooks the rail 340 such that the frame 320 can move along the rail 340.

The guide panel 350 may be connected to the front and rear surfaces of the frame 320. The guide panel 350 may be connected to the front and rear sides of the frame 320. The guide panel 350 may be connected to the first rail 341 and the fourth rail 344. The guide panel 350 may fix the frame 320 to the first rail 341 and the fourth rail 344. The guide panel 350 may connect the frame 320 to the first rail 341 and the fourth rail 344 such that the frame 320 can move in left and right directions.

A hook 359 may be formed on the guide panel 350. The hook 359 may be formed in plurality on the guide panel 350. The hook 359 may be formed in plurality on the upper side of the guide panel 350. The hook 359 may be mounted on the first rail 341 and the fourth rail 344. The hook 359 may be mounted on the first rail 341 and the fourth rail 344 such that the frame 320 can rotate in left and right directions.

The guide panel 350 may be disposed on the front surface and the rear surface of the frame 320, respectively. The guide panel 350 may support the front and rear sides of the frame 320.

In some implementations, the dishwasher 1 may include a wash tub 4 defining a space in which dishes are washed, a first upper basket 311 and a second upper basket 312 disposed side by side at an upper side of the wash tub 4, a lower basket 300 disposed under the first upper basket 311 and the second upper basket 312 to define lower reception spaces S1 and S2 for receiving dishes, and movement parts 321 and 323 that allows the first upper basket 311 to be movable to the second upper basket 312 to increase the maximum height of the lower reception space S1 and S2.

Referring to FIG. 13, a height H1 may be a height from the bottom of the lower basket 300 to the bottom of the first upper basket 311 and the second upper basket 312. A height H2 may be a height of the first upper basket 311 and the second upper basket 312. A height H3 may be a height from the upper side surfaces of the first upper basket 311 and the second upper basket 312 to the ceiling of the wash tub 4.

When the first upper basket 311 and the second upper basket 312 are disposed side by side, the maximum height of the lower reception spaces S1 and S2 may be the height H1. However, when the first upper basket 311 moves to the second upper basket 312, the maximum height of the lower reception spaces S1 and S2 may become a height that is the sum of the heights H1, H2 and H3.

In some examples, the dishwasher 1 may include a wash tub 4 defining a space in which dishes are washed, a first upper basket 311 and a second upper basket 312 disposed side by side at an upper side of the wash tub 4, a lower basket 300 disposed under the first upper basket 311 and the second upper basket 312 to receive dishes, and movement parts 321 and 323 that move the first upper basket 311 to the second upper basket 312 such that the first upper basket 311 overlaps the second upper basket 312 to increase the maximum height of a dish containable in the lower basket 300 by the height of a dish containable in the first upper basket 311.

When the first upper basket 311 and the second upper basket 312 are disposed side by side, the maximum height of a dish containable in the lower basket 300 may become the height H1. The maximum height of a dish containable in the first upper basket 311 may be the sum of the heights H2 and H3. The movement part may allow the maximum height of a dish containable in the low basket 300 to become the height H4. The movement parts 321 and 323 may allow the maximum height of a dish containable in the low basket 300 to become the height H4. The movement parts 321 and 323 may increase the maximum height of a dish containable in the low basket 300 by the sum of the heights H2 and H3.

Figure 16A:
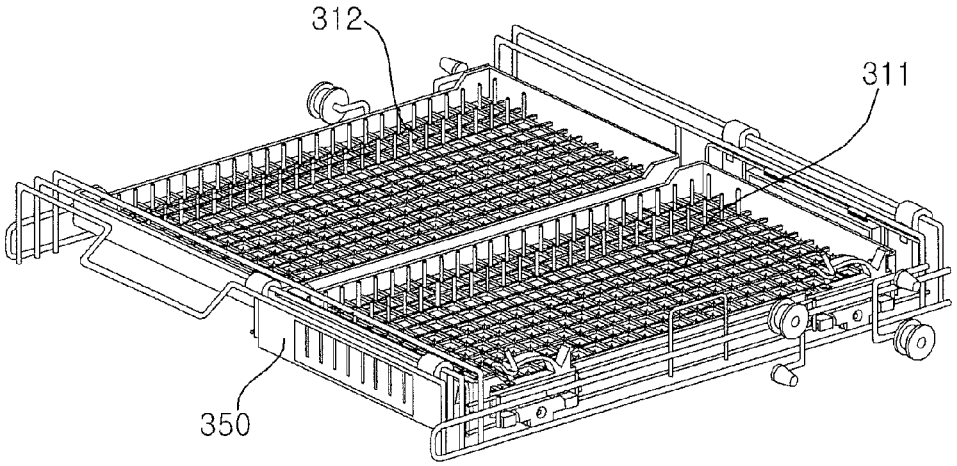
FIGS. 16A and 16B are views illustrating an example use of an example dishwasher.
Figure 16B:
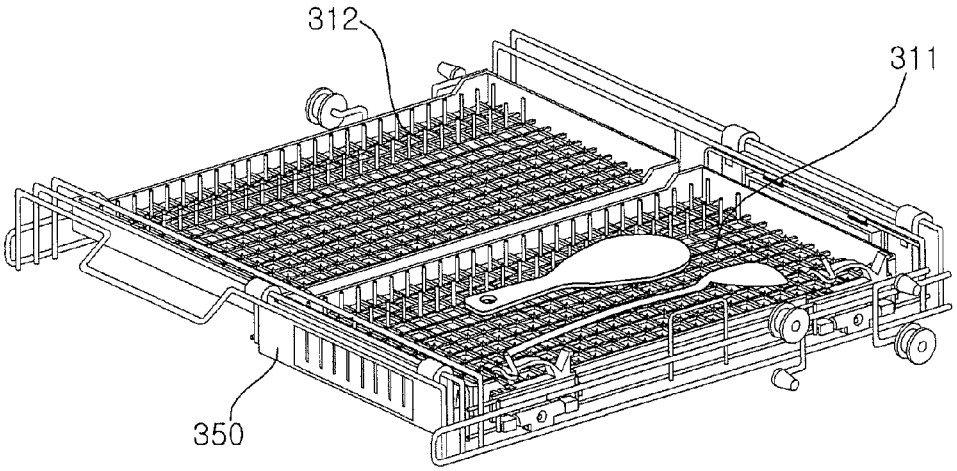

FIG. 16 illustrates an example use of a dishwasher 1. FIG. 17 illustrates another example use of a dishwasher 1. FIG. 18 illustrates still another example use of a dishwasher 1. FIG. 19 illustrates yet another example use of a dishwasher 1.

Referring to FIGS. 16 to 19, the dishwasher 1 may include a first upper basket 311 and a second upper basket 312 that are disposed side by side. The height of the first upper basket 311 may be equal to the height of the second upper basket 312.

The maximum height of a dish containable in the first upper basket 311 and the second upper basket 312 may be the sum of the heights H2 and H3. The dish reception capacities of the first upper basket 311 and the second upper basket 312 may be equal to each other. The dish reception spaces of the first upper basket 311 and the second upper basket 312 may be equal to each other. The spaces S3 and S4 may be equal to each other.

Figure 17A:
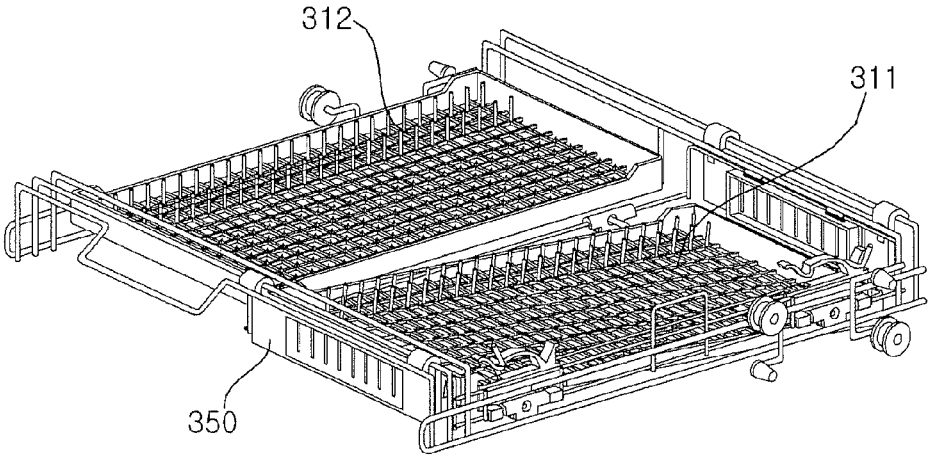
FIGS. 17A and 17B are views illustrating another example use of an example dishwasher.
Figure 17B:
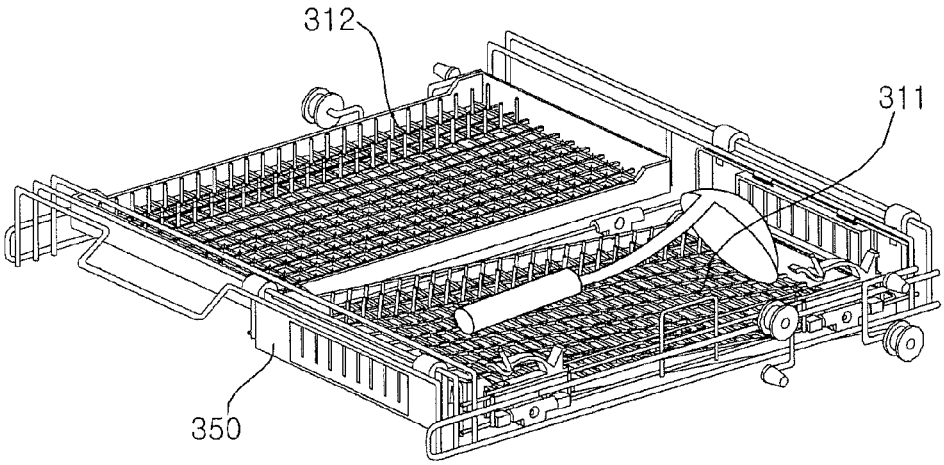

In some implementations, the dishwasher 1 may include a first upper basket 311 that inclines to one side (see FIGS. 17A and 17B). The height of the first upper basket 311 may be obliquely formed. The height of a dish containable in the first upper basket 311 may be oblique. The first upper basket 311 may contain a dish, one side of which is higher than the other side.

Figure 18A:
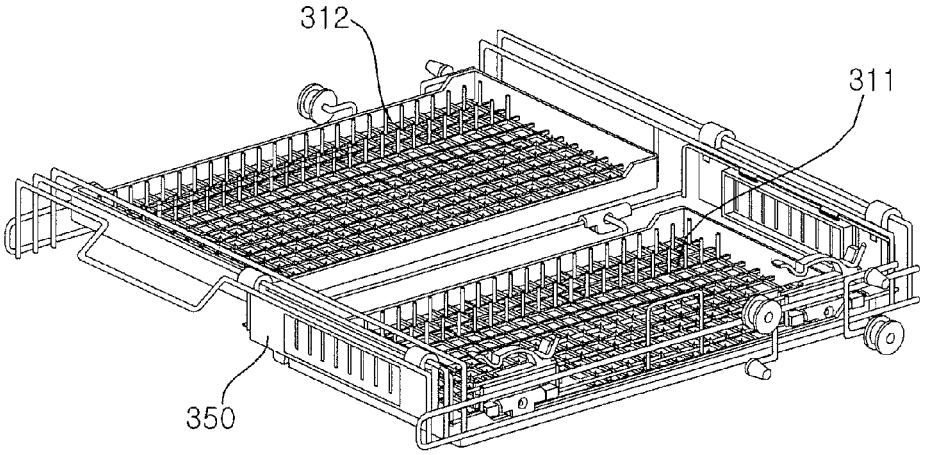
FIGS. 18A and 18B are views illustrating still another example use of an example dishwasher.
Figure 18B:
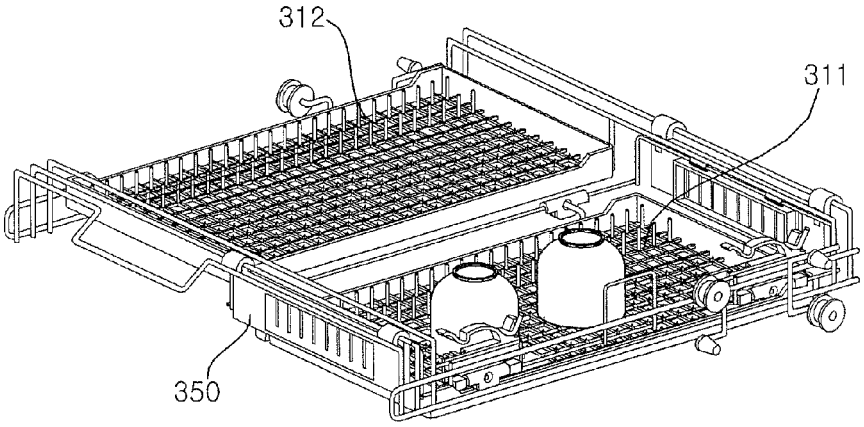

In some examples, the dishwasher 1 may include a first upper basket 311 and a second upper basket 312 that is disposed at a higher location than the first upper basket 311 (see FIGS. 18A and 18B). The first upper basket 311 may be disposed at a location diagonal to the second upper basket 312.

The maximum height of a dish containable in the first upper basket 311 may be higher than the maximum height of a dish containable in the second upper basket 312. For example, the first upper basket 311 can contain rice bowls or soup bowls. The second upper basket 312 may contain spoons and chopsticks.

Figure 19A:
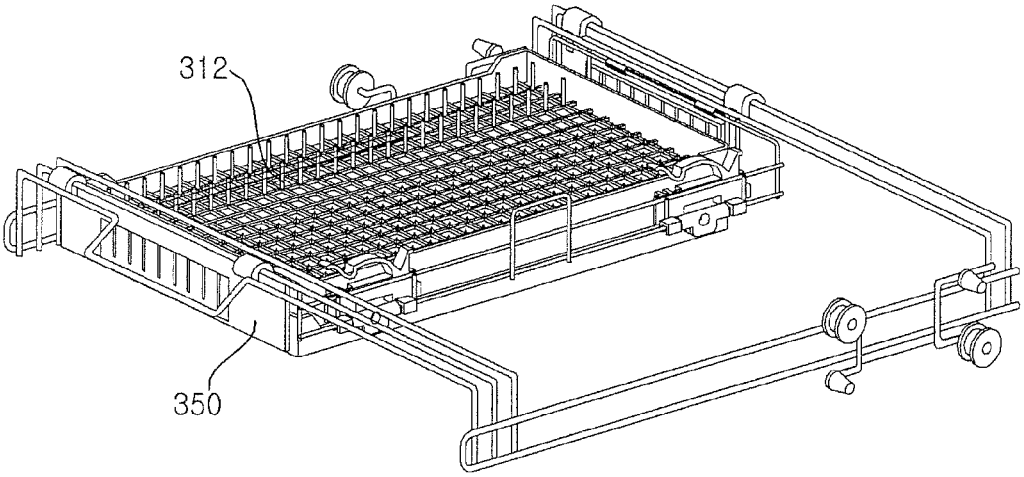
FIGS. 19A and 19B are views illustrating yet another example use of an example dishwasher.
Figure 19B:
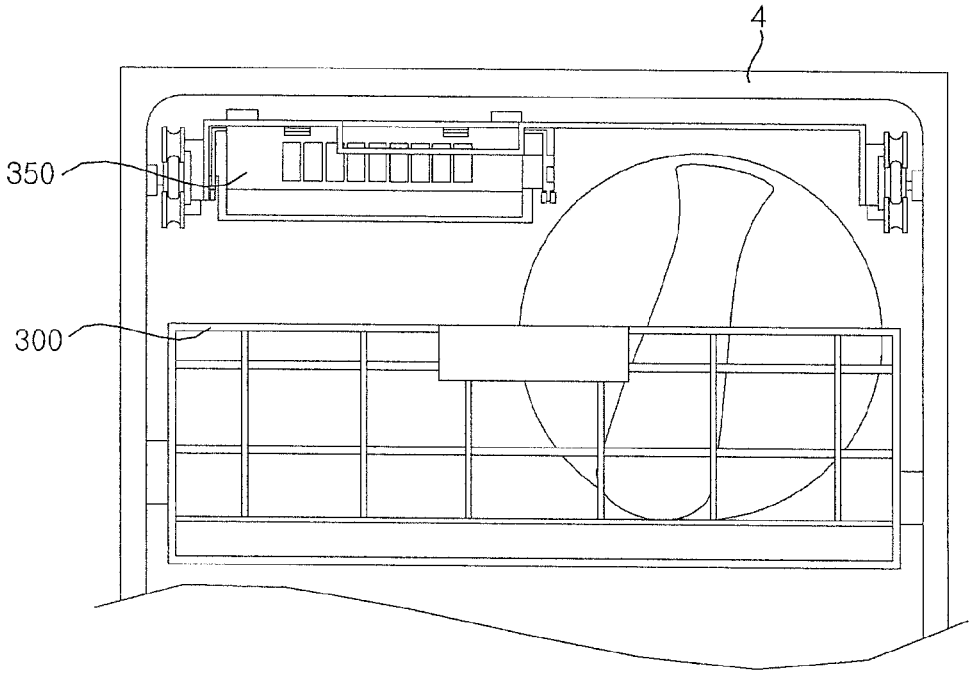

In some implementations, the dishwasher 1 may include a first upper basket 311 and a second upper basket 312 that is disposed over the first upper basket 311 (see FIGS. 19A and 19B). The maximum height of a dish containable in the lower basket 300 may be higher at one side of the lower basket. In this case, the maximum height of a dish containable at one side of the low basket 300 may become the height H4. The maximum height of a dish containable at the other side of the low basket 300 may become the height H1 minus the height H2.

A dishwasher as described herein may have one or more of the following effects.

First, the height of a basket can be adjusted according to a necessity of a user.

Second, the capacity of dishes contained in the basket can be increased.

Third, it is possible to prevent a user from removing baskets to increase a space between baskets.

Hereinafter, the operation of the dish washer 1 configured as shown in FIGS. 13-19 will be described as follows.

A user may open the door 2, and then may withdraw the lower basket 300 disposed at a lower portion of the wash tub 4. The lower basket 300 may contain dishes having relatively large sizes or diameters. When dishes contained in the lower basket 300 have large heights or large diameters, the upper portions of dishes may hit the first upper basket 311.

A user may pull the rail disposed at an upper portion of the wash tub 4 to withdraw the first upper basket 311 and the second upper basket 312. A user may lower the height of the first upper basket 311 using the adjustment parts 331 and 332. The adjustment parts 331 may operate by a method of moving the latch 331*a* that limits the movement of the stopping protrusion 315 or by a method of pulling the lever 332*a* using the principle of the lever.

The first upper basket 311 may move to a location lower than the bottom of the second upper basket 312. A user may move the frame 320 toward the second upper basket 312. The frame 320 may be connected to the guide panel 350, and the guide panel 350 may be connected to the first rail 341 and the fourth rail 344. The first upper basket 311 may move so as to completely overlap the second upper basket 312.

From the foregoing processes, the first upper basket 311 is positioned over one side of the lower basket 300 and is no longer positioned over the first lower bottom. Only the ceiling of the wash tub 4 is positioned over the first lower bottom.

Accordingly, the reception space at one side of the lower basket 300 may increase. Also, the amount of dishes containable at one side of the lower basket 300 may increase. Also, the maximum height of dishes containable at one side of the lower basket 300 may increase. The increased capacity may substantially increase the amount of dishes containable in the first upper basket 311.

The increased space may substantially become a space that the first upper basket 311 occupies. The increased maximum height of dishes may substantially become a height (sum of the height H2 and the height H3) from the bottom of the first upper basket 311 to the ceiling of the wash tub 4. Also, the maximum height of dishes containable in the lower basket 300 may become the height H4.

Also, the lower reception space S1 may increase through the foregoing processes. This is because the existing occupied space S3 moves to the side surface due to the movement of the first upper basket 311.

Through the foregoing processes, a user can adjust the locations of the first upper basket 311 and the second upper basket 312. Also, through the locations of the first upper basket 311 and the second upper basket 312, the dish reception space of the lower basket 300 can be adjusted.

It will be understood by those skilled in the art that various changes in form and details may be made therein without departing from the spirit and scope of the disclosure. The implementations and examples should be considered in descriptive sense only and not for purposes of limitation. Therefore, the scope of the disclosure is not limited by the detailed description, but encompasses the full scope of the appended claims, and all differences within the scope will be construed as being included in the present disclosure.

What is claimed is:

1. A dishwasher comprising:

a wash tub defining a space in which dishes are washed;

a lower basket disposed in the wash tub;

a first upper basket disposed over the lower basket inside the wash tub and configured to define a first lower reception space together with the lower basket;

a second upper basket disposed over the lower basket side by side with the first upper basket and configured to define a second lower reception space;

movement parts configured to move the first upper basket above or below the second upper basket such that the first upper basket occupies a same space over the lower basket as the second upper basket, thereby increasing the first lower reception space; and a stopping protrusion located on the first upper basket and protruding to a side surface of a frame, wherein the movement parts comprise:

the frame configured to receive the first upper basket;

an adjustment part disposed on the frame and configured to adjust a height of the first upper basket; and a rail connected to the frame in a manner that enables the frame to move along the rail and to move the first upper basket above or below the second upper basket, wherein the adjustment part is configured to move in a horizontal direction, and comprises a latch that limits vertical movement of the stopping protrusion.

2. The dishwasher of claim 1, wherein the rail comprises:

a first rail, a second rail, a third rail, and a fourth rail longitudinally arranged in left and right directions and sequentially arranged in forward and backward directions in the wash tub; and side rails longitudinally disposed in forward and backward directions to connect left ends and right ends of the first to fourth rails, respectively, wherein a front surface and a rear surface of the second upper basket are mounted to the second rail and the third rail.

3. The dishwasher of claim 2, further comprising rollers disposed on the side rails and configured to allow the first to fourth rails to move in forward and backward directions in the wash tub.

4. The dishwasher of claim 2, further comprising:

a guide panel that has a first side surface thereof connected to the frame; and a hook that is located at a second side surface of the guide panel and that hooks to the first rail such that the frame moves along the first rail.

5. The dishwasher of claim 4, wherein the guide panel is a first guide panel disposed on a front surface of the frame, the hook is a first hook, further comprising:

a second guide panel disposed on a rear surface of the frame; and a second hook located at the second guide panel and that hooks to the fourth rail such that the frame moves along the fourth rail.

6. A dishwasher comprising:

a wash tub defining a space in which dishes are washed;

a lower basket disposed in the wash tub;

a first upper basket disposed over the lower basket inside the wash tub and configured to define a first lower reception space together with the lower basket;

a second upper basket disposed over the lower basket side by side with the first upper basket and configured to define a second lower reception space; and movement parts configured to move the first upper basket above or below the second upper basket such that the first upper basket occupies a same space over the lower basket as the second upper basket, thereby increasing the first lower reception space, wherein the movement parts comprise:

a frame configured to receive the first upper basket;

an adjustment part disposed on the frame and configured to adjust a height of the first upper basket; and a rail connected to the frame in a manner that enables the frame to move along the rail and to move the first upper basket above or below the second upper basket, wherein the adjustment part is rotatably disposed on a side surface of the frame and configured to lift the first upper basket from the frame.

7. The dishwasher of claim 6, wherein the rail comprises:

a first rail, a second rail, a third rail, and a fourth rail longitudinally arranged in left and right directions and sequentially arranged in forward and backward directions in the wash tub; and side rails longitudinally disposed in forward and backward directions to connect left ends and right ends of the first to fourth rails, respectively, wherein a front surface and a rear surface of the second upper basket are mounted to the second rail and the third rail.

8. The dishwasher of claim 7, further comprising rollers disposed on the side rails and configured to allow the first to fourth rails to move in forward and backward directions in the wash tub.

9. The dishwasher of claim 7, further comprising:

a guide panel that has a first side surface thereof connected to the frame; and a hook that is located at a second side surface of the guide panel and that hooks to the first rail such that the frame moves along the first rail.

10. The dishwasher of claim 9, wherein the guide panel is a first guide panel disposed on a front surface of the frame, the hook is a first hook, further comprising:

a second guide panel disposed on a rear surface of the frame; and a second hook located at the second guide panel and that hooks to the fourth rail such that the frame moves along the fourth rail.

11. A dishwasher comprising:

a wash tub defining a space in which dishes are washed;

a first upper basket and a second upper basket disposed side by side at an upper side of the wash tub;

a lower basket disposed under the first upper basket and the second upper basket and configured to define at least one lower reception space for receiving dishes;

a movement member configured to allow the first upper basket to move to a position above or below the second upper basket, thereby increasing a maximum height of the at least one lower reception space; and a stopping protrusion located on the first upper basket and protruding to a side surface of a frame, wherein the movement member comprises:

the frame configured to receive the first upper basket;

an adjustment part disposed on the frame and configured to adjust a height of the first upper basket; and a rail connected to the frame in a manner that enables the frame to move along the rail and to move the first upper basket above or below the second upper basket, wherein the adjustment part is configured to move in a horizontal direction, and comprises a latch that limits vertical movement of the stopping protrusion.

12. The dishwasher of claim 11, wherein the rail comprises:

a first rail, a second rail, a third rail, and a fourth rail longitudinally arranged in left and right directions and sequentially arranged in forward and backward directions in the wash tub; and side rails longitudinally disposed in forward and backward directions to connect left ends and right ends of the first to fourth rails, respectively, wherein a front surface and a rear surface of the second upper basket are mounted to the second rail and the third rail.

13. The dishwasher of claim 12, further comprising rollers disposed on the side rails and configured to allow the first to fourth rails to move in forward and backward directions in the wash tub.

14. The dishwasher of claim 12, further comprising:

a guide panel that has a first side surface thereof connected to the frame; and a hook that is located at a second side surface of the guide panel and that hooks to the first rail such that the frame moves along the first rail.

15. A dishwasher comprising:

a wash tub defining a space in which dishes are washed;

a first upper basket and a second upper basket disposed side by side at an upper side of the wash tub;

a lower basket disposed under the first upper basket and the second upper basket and configured to define at least one lower reception space for receiving dishes; and a movement member configured to allow the first upper basket to move to a position above or below the second upper basket, thereby increasing a maximum height of the at least one lower reception space, wherein the movement member comprises:

a frame configured to receive the first upper basket;

an adjustment part disposed on the frame and configured to adjust a height of the first upper basket; and a rail connected to the frame in a manner that enables the frame to move along the rail and to move the first upper basket above or below the second upper basket, wherein the adjustment part is rotatably disposed on a side surface of the frame and configured to lift the first upper basket from the frame.

16. The dishwasher of claim 15, wherein the rail comprises:

a first rail, a second rail, a third rail, and a fourth rail longitudinally arranged in left and right directions and sequentially arranged in forward and backward directions in the wash tub; and side rails longitudinally disposed in forward and backward directions to connect left ends and right ends of the first to fourth rails, respectively, wherein a front surface and a rear surface of the second upper basket are mounted to the second rail and the third rail.

17. The dishwasher of claim 16, further comprising rollers disposed on the side rails and configured to allow the first to fourth rails to move in forward and backward directions in the wash tub.

18. The dishwasher of claim 16, further comprising:

a guide panel that has a first side surface thereof connected to the frame; and a hook that is located at a second side surface of the guide panel and that hooks to the first rail such that the frame moves along the first rail.

19. A dishwasher comprising:

a wash tub defining a space in which dishes are washed;

a first upper basket and a second upper basket disposed side by side at an upper side of the wash tub;

a lower basket disposed under the first upper basket and the second upper basket and configured to receive dishes;

movement parts configured to move the first upper basket to a position that overlaps the second upper basket, thereby increasing a maximum height of a dish containable in the lower basket by a height of a dish containable in the first upper basket; and a stopping protrusion located on the first upper basket and protruding to a side surface of a frame, wherein the movement parts comprise:

the frame configured to receive the first upper basket;

an adjustment part disposed on the frame and configured to adjust a height of the first upper basket; and a rail connected to the frame in a manner that enables the frame to move along the rail and to move the first upper basket to the position that overlaps the second upper basket, wherein the adjustment part is configured to move in a horizontal direction, and comprises a latch that limits vertical movement of the stopping protrusion.

20. A dishwasher comprising:

a wash tub defining a space in which dishes are washed;

a first upper basket and a second upper basket disposed side by side at an upper side of the wash tub;

a lower basket disposed under the first upper basket and the second upper basket and configured to receive dishes;

movement parts configured to move the first upper basket to a position that overlaps the second upper basket, thereby increasing a maximum height of a dish containable in the lower basket by a height of a dish containable in the first upper basket;

wherein the movement parts comprise:

a frame configured to receive the first upper basket;

an adjustment part disposed on the frame and configured to adjust a height of the first upper basket; and a rail connected to the frame in a manner that enables the frame to move along the rail and to move the first upper basket to the position that overlaps the second upper basket, wherein the adjustment part is rotatably disposed on a side surface of the frame and configured to lift the first upper basket from the frame.

* * * * *